US008133377B2

(12) United States Patent
Okazaki et al.

(10) Patent No.: US 8,133,377 B2
(45) Date of Patent: Mar. 13, 2012

(54) METHOD AND APPARATUS FOR PRODUCING CONDUCTIVE MATERIAL

(75) Inventors: Kentaro Okazaki, Fujinomiya (JP); Takayasu Yamazaki, Minami-ashigara (JP)

(73) Assignee: Fujifilm Corporation, Tokyo (JP)

( * ) Notice: Subject to any disclaimer, the term of this patent is extended or adjusted under 35 U.S.C. 154(b) by 1010 days.

(21) Appl. No.: 12/052,837

(22) Filed: Mar. 21, 2008

(65) Prior Publication Data

US 2008/0230393 A1 Sep. 25, 2008

(30) Foreign Application Priority Data

Mar. 23, 2007 (JP) ..... 2007-077027

(51) Int. Cl.
*C25D 5/34* (2006.01)

(52) U.S. Cl. ..... 205/219; 205/129

(58) Field of Classification Search ..... 205/129, 205/219

See application file for complete search history.

(56) References Cited

U.S. PATENT DOCUMENTS

| | | | | |
|---|---|---|---|---|
| 3,817,844 | A * | 6/1974 | Kendall | 205/118 |
| 4,663,085 | A * | 5/1987 | Enda et al. | 204/235 |
| 6,475,646 | B2 * | 11/2002 | Park et al. | 428/670 |
| 7,749,860 | B2 | 7/2010 | Yoshida et al. | |
| 2004/0229028 | A1 * | 11/2004 | Sasaki et al. | 428/220 |
| 2005/0266165 | A1 | 12/2005 | Mobius et al. | |
| 2006/0115636 | A1 | 6/2006 | Yoshida et al. | |

FOREIGN PATENT DOCUMENTS

| | | |
|---|---|---|
| CN | 1668783 | 9/2005 |
| CN | 1715444 | 1/2006 |
| JP | 2004-221565 A | 8/2004 |
| JP | 2006-012935 A | 1/2006 |
| JP | 2006-228474 A | 8/2006 |
| JP | 2006-228480 A | 8/2006 |
| JP | 2006-228836 A | 8/2006 |
| JP | 2004-221564 A | 3/2008 |

OTHER PUBLICATIONS

Chinese Official Action—200810086243.6—Aug. 11, 2010.

* cited by examiner

*Primary Examiner* — Luan Van
(74) *Attorney, Agent, or Firm* — Young & Thompson

(57) ABSTRACT

A photosensitive film, which has a transparent support and a silver salt emulsion layer containing a silver salt formed thereon, is exposed and developed to form a metallic silver portion. The base material to be plated is electrified in an electrolytic solution free of plating substances, using the metallic silver portion as a cathode. Then, the electrified base material is subjected to an electroless plating treatment to form a first plated layer only on the metallic silver portion. The base material is subjected to an electroplating treatment to form a second plated layer on the first plated layer, further form a third plated layer on the second plated layer.

10 Claims, 8 Drawing Sheets

METHOD AND APPARATUS FOR PRODUCING CONDUCTIVE MATERIAL

BACKGROUND OF THE INVENTION

1. Field of the Invention

The present invention relates to a method and an apparatus for producing a conductive material. Specifically, the conductive material according to the present invention is light transmittable and capable of shielding electromagnetic waves from microwave ovens, electronic devices, printed circuit boards, display devices such as CRT (cathode ray tube) displays, PDP (plasma display panel) displays, liquid crystal displays, EL (electroluminescence) displays, and FEDs (field emission displays), etc.

2. Description of the Related Art

The flat panel display (FPD) market has been rapidly growing due to increase in display size, demand for replacement of CRT, etc., and capacity to produce flat panel displays has been increased at high speed. Thus, it is necessary to increase capacity to produce materials for the FPDs, and particularly there is a demand for improving productivity of light transmittable, electromagnetic-shielding materials.

A technique, which comprises the steps of exposing and developing a photosensitive film having a silver salt emulsion layer, and subjecting the developed silver to a plating treatment to make the photosensitive film conductive or to increase the conductivity of the photosensitive film, is known as a method for producing the electromagnetic-shielding materials (see Japanese Laid-Open Patent Publication Nos. 2004-221564, 2004-221565, and 2006-012935, etc.) There is an increasing demand for rapid mass production using this technique, particularly for increasing plating reaction rate.

A chemical activating pretreatment, which comprises immersing a base material to be electroless-plated in an activating solution containing a noble metal such as Pd or a reducing agent such as sodium borohydride, is known as a method for increasing the plating reaction rate (see Japanese Laid-Open Patent Publication Nos. 2006-228836, 2006-228474, and 2006-228480).

However, in the chemical activating treatment using the noble metal solution, silver portions formed due to development fogging (corresponding to opening portions of a conductive film mesh-type, light transmittable, electromagnetic-shielding material) and portions other than the developed silver are chemically activated as well. The portions are inevitably covered with an unnecessary plated film (hereinafter referred to as a plating fog), whereby the light transmittability of the base material is disadvantageously reduced. Further, the plating fog is generated also due to contamination of the electroless-plating solution by the activating liquid or falling of an active core in an electroless plating solution, and causes deterioration of the electroless plating solution.

The immersion treatment using the reducing agent solution is disadvantageous in that, for example, silver portions formed due to development fogging causes the plating fog, the reducing agent per se is oxidation-degraded, and a large amount of hydrogen is generated. Thus, also the immersion treatment is not suitable for rapid production of the conductive materials.

SUMMARY OF THE INVENTION

In view of the above problems, an object of the present invention is to provide a method and an apparatus for producing a conductive material, capable of increasing the plating activity of a conductive metal portion, thereby rapidly carrying out a plating treatment without plating fog.

According to the present invention, there are provided the following means for solving the problems.

[1] A method according to a first aspect of the present invention for producing a conductive material, comprising the steps of: electrifying a base material to be plated having a conductive metal portion (e.g., a fine metal particle portion) in an electrolytic solution free of plating substances, the conductive metal portion being used as a cathode; and then subjecting the base material to a plating treatment to form a conductive layer.

In this method of the present invention for producing a conductive material, by electrifying the conductive metal portion prior to the plating treatment, an oxide, sulfide, or the like generated on the conductive metal portion can be removed, and the surface of the conductive metal portion can be activated. Thus, in the following plating treatment, the plating rate can be increased without chemical activating treatments, and plating unevenness can be reduced. As a result, the base material can be rapidly plated, and uniform conductive materials can be mass-produced.

[2] A method according to a second aspect of the present invention for producing a conductive material, comprising the steps of: exposing and developing a photosensitive film having a support and a silver salt emulsion layer containing a silver salt formed thereon, to form a metallic silver portion; electrifying the photosensitive film in an electrolytic solution substantially free of plating substances, the metallic silver portion being used as a cathode; and subjecting the metallic silver portion to a plating treatment to form a conductive layer.

In this method according to the second aspect of the present invention for producing a conductive material, by electrifying the metallic silver portion formed on the photosensitive film, the plating rate can be increased and plating unevenness can be reduced in the same manner as the first aspect of the present invention. As a result, the base material can be rapidly plated, and uniform conductive materials can be mass-produced.

Further, in the producing methods according to the first and second aspects of the present invention, plating fog is not generated unlike conventional chemical activating treatments, so that the light transmittability is not reduced, and plating solutions are not deteriorated in following processes. In the above chemical activating treatment using the reducing agent solution, it is necessary to supply the reducing agent and to remove the generated hydrogen. In contrast, in the present invention, the supply and removal is not required, and thus production equipment can be simplified and production costs can be lowered, efficiently.

[3] A method according to [1] or [2], wherein the electrolytic solution comprises an electrolyte and a solvent.

[4] A method according to [3], wherein the electrolyte contains at least one salt selected from the group consisting of alkali metal salts, ammonium salts, perchlorate salts, and borate salts.

[5] A method according to [3], wherein the solvent contains water and/or a nonaqueous solvent.

[6] A method according to [5], wherein the nonaqueous solvent contains at least one selected from the group consisting of amides, pyrolidones, nitrites, ketones, and tetrahydrofuran.

[7] A method according to any one of [1] to [6], wherein the plating treatment comprises an electroless plating treatment and/or an electroplating treatment.

[8] A method according to [7], wherein the electroplating treatment comprises a copper electroplating treatment and/or a black electroplating treatment.

[9] An apparatus according to a third aspect of the present invention for subjecting a base material to be plated having a conductive metal portion to a plating treatment to form a conductive layer, thereby producing a conductive material, comprising an electrifying unit and a plating unit disposed downstream thereof, wherein the electrifying unit comprises a feed roller for feeding electricity to the conductive metal portion in contact therewith, and an electrifying bath for electrifying the conductive metal portion in an electrolytic solution, disposed downstream of the feed roller in the direction of conveying the base material, and the plating unit comprises a plating bath for plating the conductive metal portion.

[10] An apparatus according to [9], wherein the hydrogen overvoltage of the feed roller is higher than that of the conductive metal portion.

[11] An apparatus according to [9] or [10], wherein the plating bath comprises an electroless plating bath and/or an electroplating bath.

[12] An apparatus according to [9] or [10], wherein the plating bath comprises an electroless plating bath and an electroplating bath, which are disposed in this order in the direction of conveying the base material.

[13] An apparatus according to [9] or [10], wherein the plating bath comprises an electroless plating bath, an electroplating bath, and a black electroplating bath, which are disposed in this order in the direction of conveying the base material.

As described above, according to the present invention, there are provided the method and apparatus for producing a conductive material, capable of increasing the plating activity of the conductive metal portion (e.g. fine metal particle portion), thereby rapidly carrying out the plating treatment.

The conventional chemical activating treatments are disadvantageous in that the plating fog is generated in the silver portions formed due to development fogging (corresponding to opening portions of a conductive film mesh-type, light transmittable, electromagnetic-shielding material) and portions other than the developed silver to reduce the light transmittability, and that the plating fog is generated also due to contamination of the electroless plating solution by the activating liquid or falling of the active core in the electroless plating solution, and causes deterioration of the electroless plating solution. In contrast, the method of the present invention does not have such disadvantages.

Though the fine metal particle portion can be activated by a reducing agent such as sodium borohydride, the treatment using the reducing agent is disadvantageous in that, for example, the reducing agent per se is oxidation-degraded, and a large amount of hydrogen is generated. Thus, the treatment is not suitable for rapid production of the conductive material.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
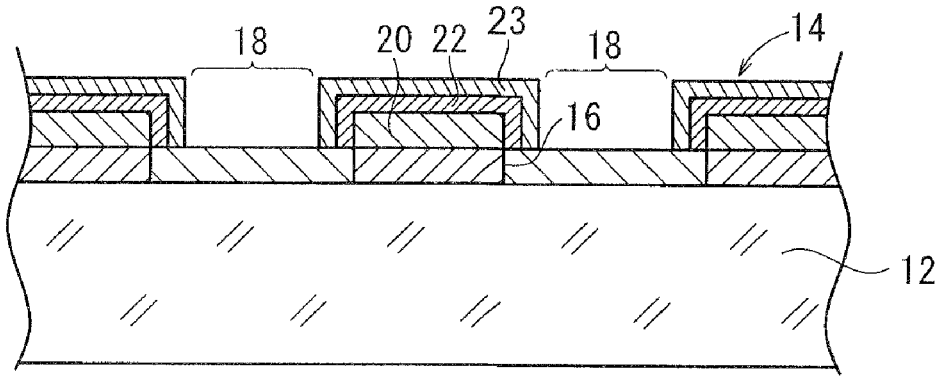
FIG. 1 is a cross-sectional view partly showing a conductive material produced by a method according to an embodiment of the present invention.

The method and apparatus of the present specification for producing a conductive material will be described in detail below.

It should be noted that, in the present specification, a numeric range of "A to B" includes both the numeric values A and B as the lower limit and upper limit values. Though generally the term "mesh" is a unit of screen coarseness, in the present specification, it means a net pattern or a net containing a plurality of fine wires according to the custom of those skilled in the art.

<Method for Producing Conductive Material>

The method of the present invention, for producing a conductive material, comprises the steps of: electrifying a base material to be plated having a conductive metal portion (e.g., a fine metal particle portion) in an electrolytic solution substantially free of plating substances, the conductive metal portion being used as a cathode; and then subjecting the base material to a plating treatment to form a conductive layer.

In the producing method of the present invention, the base material to be plated is preferably obtained by exposing and developing a photosensitive film having a support and a silver salt emulsion layer containing a silver salt formed thereon, to form a metallic silver portion.

The steps of the method according to the first aspect and the method according to the second aspect (which may be referred to as the producing method of the present invention hereinafter) will be described in detail below.

[Base Material to be Plated]

The base material to be plated used in the producing method of the present invention has a support and a conductive metal portion formed thereon. The conductive metal portion may be composed of any members having a material that can be electrified prior to the plating treatment. The conductive metal portion may comprise a metal foil as long as the advantageous effects of the present invention can be achieved. It is particularly preferred that the conductive metal portion comprises a developed silver or a silver-containing fine particle material such as a fine silver particle ink or a fine silver particle paste. In this case, the plating activity of the conductive metal portion is increased, whereby the plating treatment can be rapidly carried out without plating fog. In the fine metal particle portion, the silver content is preferably 50% by mass or more, more preferably 60% by mass or more, based on the total mass of metals. When the silver content is 50% by mass or more, time required for a physical development and/or the plating treatment can be shortened, the productivity can be improved, and the production costs can be lowered.

The formation of the conductive metal portion is not limited as long as the formed fine particle portion can be electrified. For example, the conductive metal portion may be formed by using the photosensitive film, or by printing a conductive fine metal particle ink or a conductive paste, or by drawing with a conductive fine metal particle ink using an inkjet printer.

Particularly in the case of using the conductive metal portion for a highly transmittable, mesh-type, electromagnetic-shielding material, it is necessary to form fine wires into a pattern to obtain a mesh, so that the conductive metal portion is preferably formed by using a photosensitive film having a highly uniform mesh pattern. In this formation, the photosensitive film having the support and the silver salt emulsion layer containing a silver salt is exposed and developed, whereby the metallic silver portion is formed as the conductive metal portion in an exposed area, and a light transmittable portion is formed in an unexposed area, to obtain the base material to be plated.

The above conductive ink or paste may be a conventional one for printing a wire pattern, etc. A metal contained therein is preferably a metal with electroless plating activity such as silver, palladium, gold, or platinum, particularly preferably silver. The particle diameter is preferably 100 nm or less, more preferably 50 nm or less, though not restrictive. In the paste, an epoxy resin, urethane resin, polyester resin, phenol resin, etc. is preferably used as a binder, and a thinner, toluene, etc. is preferably used as a solvent.

The conductive material according to the present invention, to be hereinafter described, is such that the conductive layer is formed on the conductive metal portion by plating.

An example of using the photosensitive film as the base material to be plated will be described in detail below.

The photosensitive film (photosensitive material) has the support and the silver salt emulsion layer formed thereon. When the photosensitive material is exposed and developed, the metallic silver portion is formed as the conductive metal portion in an exposed area, and the light transmittable portion is formed in an unexposed area, to obtain the base material to be plated.

Specific examples of methods for forming the base material to be plated include the following three processes, different in the photosensitive materials and development treatments.

(1) A process comprising subjecting a photosensitive black-and-white silver halide material free of physical development nucleus to a chemical development, to form the metallic silver portion on the material.

(2) A process comprising subjecting a photosensitive black-and-white silver halide material having a silver halide emulsion layer containing physical development nuclei to a solution physical development, to form the metallic silver portion on the material.

(3) A process comprising subjecting a stack of a photosensitive black-and-white silver halide material free of physical development nucleus and an image-receiving sheet having a non-photosensitive layer containing physical development nuclei to a diffusion transfer development, to form the metallic silver portion on the non-photosensitive image-receiving sheet.

The process of (1) is an integral black-and-white development-type method, and the metallic silver portion is formed on the photosensitive material. The resulting developed silver is a chemically developed silver having a structure of high-specific surface area filament, and shows a high activity in the following plating treatment or physical development.

In the process of (2), silver halide particles are melted around the physical development nuclei and deposited on the nuclei in an exposed area, whereby the metallic silver portion is formed on the photosensitive material. Also the process of (2) is an integral black-and-white development-type method. Though high activity can be achieved since the silver halide is deposited on the physical development nuclei in the development, the developed silver has a spherical shape with small specific surface.

In the process of (3), silver halide particles are melted in an unexposed area, and diffused and deposited on the development nuclei of the image-receiving sheet, to form the metallic silver portion on the image-receiving sheet. The process of (3) is a so-called separate-type method, and the image-receiving sheet is peeled from the photosensitive material.

A negative development treatment or a reversal development treatment can be used in these processes. In the diffusion transfer development, the negative development treatment can be carried out using an auto-positive material as the photosensitive material.

The chemical development, heat development, solution physical development, and diffusion transfer development have the meanings generally known in the art, and are explained in common photographic chemistry texts such as Shin-ichi Kikuchi, "*Shashin Kagaku* (*Photographic Chemistry*)", Kyoritsu Shuppan Co., Ltd., 1955 and C. E. K. Mees, "*The Theory of Photographic Processes, 4th ed.*", Macmillian, 1977. Though a liquid development treatment is used in this invention, a heat development may be utilized in the other application. For example, techniques described in Japanese Laid-Open Patent Publication Nos. 2004-184693, 2004-334077, and 2005-010752, and Japanese Patent Application Nos. 2004-244080 and 2004-085655 may be used.

The photosensitive material useful for producing the conductive material and a method for producing the photosensitive material will be described below.

(I) Photosensitive Material (Support)

The support of the photosensitive material used in the producing method of the present invention may be a plastic film, a plastic plate, a glass plate, etc.

Examples of materials for the plastic film and plastic plate include polyesters such as polyethylene terephthalates (PET) and polyethylene naphthalates; polyolefins such as polyethylenes (PE), polypropylenes (PP), polystyrenes, and EVA; vinyl resins such as polyvinyl chlorides and polyvinylidene chlorides; polyether ether ketones (PEEK); polysulfones (PSF); polyether sulfones (PES); polycarbonates (PC); polyamides; polyimides; acrylic resins; and triacetyl celluloses (TAC).

In the present invention, it is preferred that the plastic film is a polyethylene terephthalate film from the viewpoints of transparency, heat resistance, handling, and cost.

Electromagnetic wave-shielding materials for displays have to be transparent, and thus it is preferred that the support has high transparency. In view of using the support for displays, the total visible light transmittance of the plastic film or plate is preferably 70% to 100%, more preferably 85% to 100%, particularly preferably 90% to 100%. The plastic film and plastic plate may be colored in the present invention, as long as they do not interfere with the advantageous effects of the invention.

In the present invention, the plastic film and plastic plate may have a monolayer structure or a multilayer structure containing two or more layers.

The transparent support is preferably composed of a flexible material. The thickness of the support is preferably 5 to 200 μm, more preferably 30 to 150 μm. When the thickness is within the above range, a desired visible light transmittance can be obtained, and the support can be easily handled. The transparent support is preferably a film having a width of 2 cm or more and a length of 3 m or more, and more preferably a having a width of 20 cm or more and a length of 30 m or more.

(Protective Layer)

The photosensitive material may have a protective layer formed on an emulsion layer to be hereinafter described. The protective layer used in the present invention comprises a binder such as a gelatin or high-molecular polymer, and is formed on a photosensitive emulsion layer to improve the scratch prevention or mechanical property. The thickness of the protective layer is 0.02 to 20 μm, preferably 0.1 to 10 μm, more preferably 0.3 to 3 μm. The protective layer may be formed by an appropriate known coating method though not particularly restricted.

The emulsion layer of the photosensitive material for the producing method of the present invention may contain a dye known as an additive for coloring an emulsion.

(Emulsion Layer)

The photosensitive material for the producing method of the present invention has the emulsion layer containing a silver salt (a silver salt-containing layer), formed as a light sensor on the support. The emulsion layer may contain a dye, a binder, a solvent, etc., as needed, in addition to the silver salt.

—Silver Salt—

The silver salt for the producing method of the present invention may be an inorganic silver salt such as a silver halide or an organic silver salt such as silver acetate. In the present invention, the silver salt is preferably a silver halide excellent in light sensing property.

The silver halide, preferably used in the present invention, will be described below.

In the present invention, the silver halide is preferably used as a light sensor. Technologies for silver salt photographic films, photographic papers, print engraving films, emulsion masks for photomasking, and the like, using the silver halide, may be utilized in the present invention.

The silver halide may contain a halogen element of chlorine, bromine, iodine, or fluorine, and may contain a combination of the elements. For example, the silver halide preferably contains AgCl, AgBr, or AgI, and more preferably contains AgBr or AgCl, as a main component. Also silver chlorobromide, silver iodochlorobromide, and silver iodobromide may be preferably used as the silver halide. The silver halide is further preferably silver chlorobromide, silver bromide, silver iodochlorobromide, or silver iodobromide, most preferably silver chlorobromide or silver iodochlorobromide having a silver chloride content of 50 mol % or more.

The term "the silver halide contains AgBr (silver bromide) as a main component" means that the mole ratio of bromide ion is 50% or more in the silver halide composition. The silver halide containing AgBr as a main component may contain iodide ion or chloride ion in addition to the bromide ion.

The silver halide is in the state of solid particles. The average particle size of the silver halide particles is preferably 0.1 to 1000 nm (1 μm), more preferably 0.1 to 100 nm, further preferably 1 to 50 nm, in spherical equivalent diameter, in view of the image quality of a patterned metallic silver layer formed after the exposure and development treatments.

The spherical equivalent diameter of the silver halide particle means a diameter of a spherical particle having the same volume as the silver halide particle.

The shape of the silver halide particle is not particularly limited, and may be a spherical shape, a cubic shape, a tabular shape (such as a tabular hexagonal shape, a tabular triangular shape, or a tabular quadrangular shape), an octahedron shape, a tetradecahedron shape, etc. The silver halide particle preferably has a cubic shape or a tetradecahedron shape.

The inside and the surface of the silver halide particle may comprise one uniform phase or different phases. Further, the silver halide particle may have a localized layer having a different halogen composition inside or on the surface thereof.

A silver halide emulsion is used as a coating liquid for the emulsion layer in the present invention, and it may be prepared by a method described in P. Glafkides, "*Chimie et Physique Photographique*", PaulMontel, 1967, G. F. Dufin, "*Photographic Emulsion Chemistry", The Forcal Press,* 1966, V. L. Zelikman, et al., "*Making and Coating Photographic Emulsion*", The ForcaPress, 1964, etc.

Thus, the silver halide emulsion may be prepared by an acidic process or a neutral process. Further, a soluble silver salt and a soluble halogen salt may be reacted by using a one-side mixing process, a simultaneous mixing process, or a combination thereof.

The silver particles may be formed in the presence of excess silver ions by a so-called reverse mixing process. Further, the formation may be achieved by using a so-called controlled double jet method, one of the simultaneous mixing processes containing maintaining a constant pAg in a liquid phase for producing the silver halide.

It is also preferred that the silver particles are formed using a so-called silver halide solvent such as ammonia, a thioether, or a tetrasubstituted thiourea. The solvent is more preferably a tetrasubstituted thiourea compound as described in Japanese Laid-Open Patent Publication Nos. 53-82408 and 55-77737. Preferred thiourea compounds include tetramethylthiourea and 1,3-dimethyl-2-imidazolidinethione. The amount of the silver halide solvent added is preferably $10^{-5}$ to $10^{-2}$ mol per 1 mol of the silver halide, though the amount may be changed depending on the types of compounds used, the desired particle size, and the desired halogen composition.

The controlled double jet method and the particle forming method using the silver halide solvent are preferred in the present invention because a silver halide emulsion having a regular crystal shape and a narrow particle size distribution can be easily prepared by using the methods.

It is preferred that the silver particles are rapidly grown within a range of the critical saturation degree to obtain a uniform particle size by using a method of changing the addition rate of silver nitrate or an alkali halide according to particle growth rate as described in UK Patent No. 1,535,016, and Japanese Patent Publication Nos. 48-36890 and 52-16364, or a method of changing the concentration of an aqueous solution as described in UK Patent No. 4,242,445 and Japanese Laid-Open Patent Publication No. 55-158124.

The silver halide emulsion used for forming the emulsion layer in the present invention is preferably a monodisperse emulsion, and the variation coefficient thereof, obtained by {(Standard deviation of particle size)/(Average particle size)}×100, is preferably 20% or less, more preferably 15% or less, most preferably 10% or less.

The silver halide emulsion for the present invention may be a mixture of a plurality of emulsions having different particle sizes.

The silver halide emulsion for the present invention may contain a metal of Group VIII or VIIB. It is particularly preferred that the silver halide emulsion contains a rhodium compound, an iridium compound, a ruthenium compound, an iron compound, an osmium compound, or the like to achieve high contrast and low fogging. Those compounds may have various ligands, and examples of the ligands include cyanide ions, halogen ions, thiocyanate ions, nitrosyl ions, water, hydroxide ions, pseudohalogens, ammonia, and organic molecules such as amines (methylamine, ethylenediamine, etc.), heterocyclic compounds (imidazole, thiazole, 5-methylthiazole, mercaptoimidazole, etc.), urea, and thiourea.

Doping with a hexacyano-metal complex such as $K_4[Fe(CN)_6]$, $K_4[Ru(CN)_6]$, or $K_3[Cr(CN)_6]$ is effective for increasing sensitivity.

The rhodium compound may be a water-soluble rhodium compound. Examples of the water-soluble rhodium compounds include halogenated rhodium (III) compounds, hexachloro-rhodium (III) complex salts, pentachloro-aquo-rhodium complex salts, tetrachloro-diaquo-rhodium complex salts, hexabromo-rhodium (III) complex salts, hexamine-rhodium (III) complex salts, trioxalato rhodium (III) complex salts, and $K_3Rh_2Br_9$.

The rhodium compound is used in the state of a solution of water or an appropriate solvent. The rhodium compound solution may be stabilized by a common method of adding an aqueous hydrogen halide solution (such as hydrochloric acid, hydrobromic acid, or hydrofluoric acid) or an alkali halide (such as KCl, NaCl, KBr, or NaBr). Instead of using the water-soluble rhodium compound, another silver halide particles, which are doped with rhodium beforehand, may be added to and dissolved in a mixture for preparing the silver halide.

Examples of the iridium compounds include hexachloro-iridium complex salts such as $K_2IrCl_6$ and $K_3IrCl_6$, hexabromo-iridium complex salts, hexamine-iridium complex salts, and pentachloro-nitrosyl-iridium complex salts.

Examples of the ruthenium compounds include hexachloro-ruthenium, pentachloronitrosylruthenium, and $K_4[Ru(CN)_6]$.

Examples of the iron compounds include potassium hexacyanoferrate (II) and ferrous thiocyanate.

Ruthenium and osmium mentioned above are added in the state of a water-soluble complex salt described in Japanese Laid-Open Patent Publication Nos. 63-2042, 1-285941, 2-20852, and 2-20855, etc. The water-soluble complex salt is particularly preferably a six-coordinate complex represented by the formula $[ML_6]^{-n}$, in which M represents Ru or Os, n represents 0, 1, 2, 3, or 4, and L represents a ligand.

L is not important, and may be an ammonium or alkali metal ion. Preferred ligands include halide ligands, cyanide ligands, cyanoxide ligands, nitrosyl ligands, and thionitrosyl ligands. Specific examples of such complexes for the present invention are illustrated below without intention of restricting the scope of the invention.

$[RuCl_6]$, $[RuCl_4(H_2O)_2]^{-1}$, $[RuCl_5(NO)]^{-2}$, $[RuBr_5(NS)]^{-2}$, $[Ru(CO)_3Cl_3]^{-2}$, $[Ru(CO)Cl_5]^{-2}$, $[Ru(CO)Br_5]^{-2}$, $[OsCl_6]^{-3}$, $[OsCl_5(NO)]^{-2}$, $[Os(NO)(CN)_5]^{-2}$, $[Os(NS)Br_5]^{-2}$, $[Os(CN)_6]^{-4}$, $[OS(O)_2(CN)_5]^{-4}$.

The amount of the compound added per 1 mol of the silver halide is preferably $10^{-1}$ to $10^{-2}$ mol/mol Ag, more preferably $10^{-9}$ to $10^{-3}$ mol/mol Ag.

Further, in the present invention, the silver halide may preferably contain Pd (II) ion and/or Pd metal. Pd is preferably contained near the surface of the silver halide particle though it may be uniformly distributed therein. The term "Pd is contained near the surface of the silver halide particle" means that the particle has a layer with a higher palladium content in a depth of 50 nm or less from the surface.

Such silver halide particles can be prepared by adding Pd during the silver halide particle formation. Pd is preferably added after the silver ion and halogen ion are added by 50% or more of the total amounts respectively. Further, it is also preferred that the Pd (II) ion is added in after-ripening to obtain the silver halide particle containing Pd near the surface.

The Pd-containing silver halide particles act to accelerate the physical development and electroless plating, improve production efficiency of a desired electromagnetic-shielding material, and lower the production cost. Pd is well known as an electroless plating catalyst. In the present invention, Pd can be located near the surface of the silver halide particle, so that the remarkably expensive Pd can be saved.

In the present invention, the content of the Pd ion and/or Pd metal per 1 mol of silver in the silver halide is preferably $10^{-4}$ to 0.5 mol/mol Ag, and more preferably 0.01 to 0.3 mol/mol Ag.

Examples of Pd compounds useful for the silver halide include $PdCl_2$ and $Na_2PdCl_4$.

In the present invention, the sensitivity as the light sensor can be improved by chemical sensitization, which is generally used for photographic emulsions. Examples of the chemical sensitization methods include chalcogen sensitization methods (e.g., sulfur sensitization methods, selenium sensitization methods, tellurium sensitization methods), noble metal sensitization methods (e.g., gold sensitization methods), and reduction sensitization methods. The methods may be used singly or in combination. Preferred combinations of the chemical sensitization methods include combinations of a sulfur sensitization method and a gold sensitization method, combinations of a sulfur sensitization method, a selenium sensitization method, and a gold sensitization method, combinations of a sulfur sensitization method, a tellurium sensitization method, and a gold sensitization method, etc.

The sulfur sensitization is generally carried out such that a sulfur sensitizer is added to the emulsion, and the emulsion is stirred at a high temperature of 40° C. or higher for a predetermined time. The sulfur sensitizer may be a known sulfur compound, and examples thereof include sulfur compounds contained in gelatin, thiosulfate salts, thiourea compounds, thiazole compounds, and rhodanin compounds. The sulfur compound is preferably a thiosulfate salt or a thiourea compound. The amount of the sulfur sensitizer added per 1 mol of the silver halide is preferably $10^{-7}$ to $10^{-2}$ mol, more preferably $10^{-5}$ to $10^{-3}$ mol, though the amount may be changed depending on various conditions such as pH, temperature, and silver halide particle size in a chemical ripening process.

A selenium sensitizer is used for the selenium sensitization, and it may be a known selenium compound. Thus, the selenium sensitization is generally carried out such that an unstable and/or non-unstable selenium compound is added to the emulsion, and the emulsion is stirred at a high temperature of 40° C. or higher for a predetermined time. Examples of the unstable selenium compounds include those described in Japanese Patent Publication Nos. 44-15748 and 43-13489, Japanese Laid-Open Patent Publication Nos. 4-109240 and 4-324855, etc. In particular, a compound represented by the general formula (VIII) or (IX) of Japanese Laid-Open Patent Publication No. 4-324855 is preferably used as the unstable selenium compound.

A tellurium sensitizer is used in the tellurium sensitization for generating silver telluride on the surface or in the inside of the silver halide particle, and the silver telluride is estimated to act as a sensitization nucleus. The rate of the generation of the silver telluride in the silver halide emulsion can be examined by a method described in Japanese Laid-Open Patent Publication No. 5-313284. Specific examples of the tellurium sensitizers include compounds described in U.S. Pat. Nos. 1,623,499, 3,320,069, and 3,772,031; UK Patent Nos. 235, 211, 1,121,496, 1,295,462, and 1,396,696; Canadian Patent No. 800,958; Japanese Laid-Open Patent Publication Nos. 4-204640, 4-271341, 4-333043, and 5-303157; *J. Chem. Soc., Chem. Commun.*, 635 (1980); ibid, 1102 (1979); ibid, 645 (1979); *J. Chem. Soc., Perkin. Trans.* 1, 2191 (1980); S. Patai, "*The Chemistry of Organic Selenium and Tellurium Compounds*", Vol. 1 (1986); and ibid, Vol. 2 (1987). Particularly preferred are compounds represented by the general formula (II), (III), and (IV) of Japanese Laid-Open Patent Publication No. 5-313284.

In the present invention, the amount of the selenium or tellurium sensitizer used per 1 mol of the silver halide is generally about $10^{-8}$ to $10^{-2}$ mol, preferably about $10^{-7}$ to $10^{-3}$ mol, though the amount may be changed depending on the silver halide particles used, the chemical ripening conditions, etc. In the chemical sensitization in the present invention, pH is 5 to 8, pAg is 6 to 11, preferably 7 to 10, and the temperature is 40° C. to 95° C., preferably 45° C. to 85° C., though the conditions of the chemical sensitization are not particularly limited.

The noble metal sensitization may be gold sensitization, platinum sensitization, palladium sensitization, iridium sensitization, or the like, and the gold sensitization is particularly preferred. A gold sensitizer is used in the gold sensitization, and specific examples thereof include chlorauric acid, potassium chloroaurate, potassium aurithiocyanate, gold sulfide, gold (I) thioglucose, and gold (I) thiomannose. The amount of the gold sensitizer used per 1 mol of the silver halide may be about $10^{-7}$ to $10^{-2}$ mol. A cadmium salt, a sulfite salt, a lead salt, a thallium salt, or the like may be contained in the silver halide emulsion during the silver halide particle formation or physical ripening process.

The reduction sensitization may be carried out in the present invention. Examples of reduction sensitizers include stannous salts, amines, formamidinesulfinic acid, and silane compounds. A thiosulfonic acid compound may be added to the silver halide emulsion by a method described in EP-A-293917. In the present invention, only one silver halide emulsion may be used for preparing the photosensitive material, or alternatively a plurality of silver halide emulsions may be used in combination therefor. For example, emulsions different in average particle size, halogen composition, crystal habit, chemical sensitization conditions, or sensitivity may be used in combination. It is preferred for increased contrast that an emulsion with a higher sensitivity is applied to a region closer to the support as described in Japanese Laid-Open Patent Publication No. 6-324426.

—Dye—

The photosensitive material may contain a dye in at least the emulsion layer. The dye is contained in the emulsion layer as a filter dye or for a purpose of irradiation prevention, etc. The dye may be a solid dispersion dye. Preferred examples of the dyes useful for the present invention include dyes represented by the general formulae (FA), (FA1), (FA2), and (FA3) of Japanese Laid-Open Patent Publication No. 9-179243, and specifically preferred dyes include the compounds F1 to F34 of this patent publication. The examples of preferred dyes further include (II-2) to (II-24), (III-5) to (III-18), and (IV-2) to (IV-7) described in Japanese Laid-Open Patent Publication No. 7-152112.

The dye may be used in the present invention is in the state of solid fine particle dispersion and decolored in a development or fixation treatment. Examples of such dyes include cyanine dyes, pyrylium dyes, and aminium dyes described in Japanese Laid-Open Patent Publication No. 3-138640. Examples of dyes that are not decolored in the treatment include cyanine dyes having a carboxyl group described in Japanese Laid-Open Patent Publication No. 9-96891; cyanine dyes having no acidic groups described in Japanese Laid-Open Patent Publication No. 8-245902; lake cyanine dyes described in Japanese Laid-Open Patent Publication No. 8-333519; cyanine dyes described in Japanese Laid-Open Patent Publication No. 1-266536; holopolar cyanine dyes described in Japanese Laid-Open Patent Publication No. 3-136038; pyrylium dyes described in Japanese Laid-Open Patent Publication No. 62-299959; polymer cyanine dyes described in Japanese Laid-Open Patent Publication No. 7-253639; solid fine particle dispersions of oxonol dyes described in Japanese Laid-Open Patent Publication No. 2-282244; light scattering particles described in Japanese Laid-Open Patent Publication No. 63-131135; $Yb^{3+}$ compounds described in Japanese Laid-Open Patent Publication No. 9-5913; and ITO powders described in Japanese Laid-Open Patent Publication No. 7-113072. Further, dyes represented by the general formulae (F1) and (F2) of Japanese Laid-Open Patent Publication No. 9-179243, specifically the compounds F35 to F112, may be used in the present invention.

The above dye may be a water-soluble dye, and examples thereof include oxonol dyes, benzylidene dyes, merocyanine dyes, cyanine dyes, and azo dyes. Among them, oxonol dyes, hemioxonol dyes, and benzylidene dyes are effective in the present invention. Specific examples of the water-soluble dyes useful in the present invention include dyes described in UK Patent Nos. 584,609 and 1,177,429; Japanese Laid-Open Patent Publication Nos. 48-85130, 49-99620, 49-114420, 52-20822, 59-154439, and 59-208548; and U.S. Pat. Nos. 2,274,782, 2,533,472, 2,956,879, 3,148,187, 3,177,078, 3,247,127, 3,540,887, 3,575,704, 3,653,905, and 3,718,427.

The mass ratio of the dye to the solid contents in the emulsion layer is preferably 0.01% to 10% by mass, more preferably 0.1% to 5% by mass, in view of the effects such as the irradiation prevention effect and the sensitivity reduction due to the excessively large amount of the dye added.

—Binder—

A binder may be used in the emulsion layer to uniformly disperse the silver salt particles and to help the emulsion layer adhere to the support. The binder may be a water-insoluble or water-soluble polymer, and is preferably a water-soluble polymer.

Examples of the binders include gelatins, polyvinyl alcohols (PVA), polyvinyl pyrolidones (PVP), polysaccharides such as starches, celluloses and derivatives thereof, polyethylene oxides, polysaccharides, polyvinylamines, chitosans, polylysines, polyacrylic acids, polyalginic acids, polyhyaluronic acids, and carboxycelluloses. These binders show a neutral, anionic, or cationic property due to ionicity of a functional group.

The amount of the binder in the emulsion layer is not particularly limited, and may be selected to achieve the dispersion and adhesion properties.

—Solvent—

The solvent for forming the emulsion layer is not particularly limited, and examples thereof include water, organic solvents (e.g., alcohols such as methanol, ketones such as acetone, amides such as formamide, sulfoxides such as dimethyl sulfoxide, esters such as ethyl acetate, ethers), ionic liquids, and mixtures thereof.

The mass ratio of the solvent to the total of the silver salt, the binder, and the like in the emulsion layer is 30% to 90% by mass, preferably 50% to 80% by mass.

(II) Production of Base Material to be Plated (Exposure)

First the photosensitive material is exposed to a light. The photosensitive material has the transparent support and the emulsion layer formed thereon.

In the producing method of the present invention, the silver salt emulsion layer is preferably irradiated with a laser light. The exposure of the photosensitive material is carried out by scanning with an optical beam while conveying the photosensitive material. Various laser beams may be used as the optical beam.

The silver salt-containing layer is preferably exposed in a predetermined pattern by scanning with a laser beam. For example, a capstan-type laser scanning exposure apparatus described in Japanese Laid-Open Patent Publication No. 2000-39677, etc. may be preferably used for the exposure. In the capstan-type apparatus, a DMD (digital mirror device) described in Japanese Laid-Open Patent Publication No. 2004-1244 may be used instead of a rotary polygon mirror in the optical beam scanning system, or proximity exposure described in Japanese Laid-Open Patent Publication No. 2007-72171 may be used instead of the direct laser exposure.

(Development Treatment)

In the present invention, the emulsion layer may be subjected to a development treatment after the exposure, using common development technologies for silver salt photographic films, photographic papers, print engraving films, emulsion masks for photomasking, etc. A developer for the development treatment is not particularly limited, and may be a PQ developer, an MQ developer, and MAA developer, etc. Examples of commercially available developer usable in the present invention include CN-16, CR-56, CP45X, FD-3, and PAPITOL available from FUJIFILM Corporation, C-41, E-6, RA-4, D-19, and D-72 available from Eastman Kodak Company, and developers contained in kits thereof. The developer may be a lith developer such as D85 available from Eastman Kodak Company. In the present invention, by the exposure and development treatments, a metallic silver portion, preferably a patterned metallic silver portion, is formed in an exposed area, and a light transmittable portion to be hereinafter described is formed in an unexposed area.

In the producing method of the present invention, a dihydroxybenzene developing agent may be used as the developer. Examples of the dihydroxybenzene developing agents include hydroquinone, chlorohydroquinone, isopropylhydroquinone, methylhydroquinone, and hydroquinone monosulfonate, and particularly preferred among them is hydroquinone. The dihydroxybenzene developing agent may be used in combination with an auxiliary developing agent showing superadditivity, such as a 1-phenyl-3-pyrazolidone compound or a p-aminophenol compound. In the producing method of the present invention, a combination of the dihydroxybenzene developing agent and the 1-phenyl-3-pyrazolidone compound, and a combination of the dihydroxybenzene developing agent and the p-aminophenol compound can be preferably used as the developer.

Specific examples of the 1-phenyl-3-pyrazolidone compounds and derivatives thereof, which can be used as the auxiliary developing agent in combination with the developing agent, include 1-phenyl-3-pyrazolidone, 1-phenyl-4,4-dimethyl-3-pyrazolidone, and 1-phenyl-4-methyl-4-hydroxymethyl-3-pyrazolidone.

Examples of the p-aminophenol-based auxiliary developing agent include N-methyl-p-aminophenol, p-aminophenol, N-(β-hydroxyethyl)-p-aminophenol, and N-(4-hydroxyphenyl)glycine, and preferred among them is N-methyl-p-aminophenol. Though the amount of the dihydroxybenzene developing agent is generally 0.05 to 0.8 mol/L, in the present invention, the amount is preferably 0.23 mol/L or more, more preferably 0.23 to 0.6 mol/L. When the dihydroxybenzene developing agent is used in combination with the 1-phenyl-3-pyrazolidone compound or the p-aminophenol compound, the amount of the 1-phenyl-3-pyrazolidone compound is preferably 0.23 to 0.6 mol/L, more preferably 0.23 to 0.5 mol/L, and the amount of the p-aminophenol compound is preferably 0.06 mol/L or less, more preferably 0.003 to 0.03 mol/L.

In the present invention, both of a development initiator and a development replenisher preferably has the characteristic that, when 0.1 mol of sodium hydroxide is added to 1 L of the liquid, the pH is increased by 0.5 or less. This characteristic of the development initiator or the development replenisher may be evaluated by the steps of adjusting the pH of the development initiator or the development replenisher to 10.5, adding 0.1 mol of sodium hydroxide to 1 L of the liquid, measuring the pH of the liquid, and judging whether the pH is increased only by 0.5 or less. In the producing method of the present invention, it is particularly preferred that the development initiator and the development replenisher each show a pH increase of 0.4 or less in the evaluation.

The development initiator and the development replenisher having the above characteristic can be preferably obtained by using a buffer. Examples of the buffers include carbonates; boric acid compounds described in Japanese Laid-Open Patent Publication No. 62-186259; saccharides described in Japanese Laid-Open Patent Publication No. 60-93433, such as saccharose; oxime compounds such as acetoxime; phenol compounds such as 5-sulfosalicylic acid; and tertiary phosphates such as sodium salts and potassium salts. The buffer is preferably a carbonate or boric acid. The amount of the buffer, particularly the carbonate, is preferably 0.25 mol/L or more, particularly preferably 0.25 to 1.5 mol/L.

In the present invention, the pH of the development initiator is preferably 9.0 to 11.0, particularly preferably 9.5 to 10.7. Also the development replenisher and a development tank used in continuous treatment preferably show a pH value within this range. An alkali agent for adjusting the pH may be a common, water-soluble, inorganic alkali metal salt, such as sodium hydroxide, potassium hydroxide, sodium carbonate, or potassium carbonate.

In the producing method of the present invention, the amount of the development replenisher in the developer, used for treating 1 $m^2$ of the photosensitive material, is 323 mL or less, preferably 323 to 30 mL, particularly 225 to 50 mL. The development replenisher may have the same composition as the development initiator, and may have a content of a component consumed in the development higher than that of the development initiator.

The developer for developing the photosensitive material in the present invention (the development initiator and the development replenisher may be hereinafter referred to together as the developer) may contain a common additive such as a preservative agent and or a chelating agent. Examples of the preservatives include sulfite salts such as sodium sulfite, potassium sulfite, lithium sulfite, ammonium sulfite, sodium bisulfite, potassium disulfite, and formaldehyde sodium bisulfite. The amount of the sulfite salt used is preferably 0.20 mol/L or more, more preferably 0.3 mol/L or more. When the amount of the sulfite salt added is excessively large, the sulfite salt causes silver stain in the developer. Thus, the upper limit of the amount of the sulfite salt is preferably 1.2 mol/L. The amount of the sulfite salt is particularly preferably 0.35 to 0.7 mol/L. A small amount of an ascorbic acid derivative may be used in combination with the sulfite salt as the preservative for the dihydroxybenzene developing agent. The ascorbic acid derivative may be ascorbic acid, erythorbic acid (a stereoisomer thereof), or an alkali metal salt thereof (a salt of sodium, potassium, etc.) It is preferred that sodium erythorbate is used as the ascorbic acid derivative from the viewpoint of material cost. The mol ratio of the ascorbic acid derivative to the dihydroxybenzene developing agent is preferably 0.03 to 0.12, particularly preferably 0.05 to 0.10. When the ascorbic acid derivative is used as the preservative, the developer is preferably free from boron compounds.

Examples of the additives for the developer, other than the above ones, include development inhibitors such as sodium bromide and potassium bromide; organic solvents such as ethylene glycol, diethylene glycol, triethylene glycol, and dimethylformamide; development accelerators such as alkanolamines (e.g., diethanolamine, triethanolamine), imidazole, and derivatives thereof; and antifogging agents and black pepper inhibitors, such as mercapto compounds, indazole compounds, benzotriazole compounds, and benzimidazole compounds. Specific examples of the benzimidazole compounds include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenztriazole, sodium 4-[(2-mercapto-1,3,4-thiadiazole-2-yl)thio]butanesulfonate, 5-amino-1,3,4-thiadiazole-2-thiol, methylbenzotriazole, 5-methylbenzotriazole, and 2-mercaptobenzotriazole. The amount of the benzimidazole compound per 1 L of the developer is generally 0.01 to 10 mmol, more preferably 0.1 to 2 mmol.

The developer may contain an organic or inorganic chelating agent. Examples of the inorganic chelating agents include sodium tetrapolyphosphate and sodium hexametaphosphate. Examples of the organic chelating agents include organic carboxylic acids, aminopolycarboxylic acids, organic phosphonic acids, aminophosphonic acids, and organic phosphonocarboxylic acids.

Examples of the organic carboxylic acids include acrylic acid, oxalic acid, malonic acid, succinic acid, glutaric acid, adipic acid, pimelic acid, azelaic acid, sebacic acid, nonanedicarboxylic acid, decanedicarboxylic acid, undecanedicarboxylic acid, maleic acid, itaconic acid, malic acid, citric acid, and tartaric acid, though not restrictive.

Examples of the aminopolycarboxylic acids include iminodiacetic acid, nitrilotriacetic acid, nitrilotripropionic acid, ethylenediaminemonohydroxyethyltriacetic acid, ethylenediaminetetraacetic acid, glycol ether tetraacetic acid, 1,2-diaminopropanetetraacetic acid, diethylenetriaminepentaacetic acid, triethylenetetraminehexaacetic acid, 1,3-diamino-2-propanoltetraacetic acid, glycol ether diaminetetraacetic acid, and compounds described in Japanese Laid-Open Patent Publication Nos. 52-25632, 55-67747, and 57-102624, and Japanese Patent Publication No. 53-40900, etc.

Examples of the organic phosphonic acids include hydroxyalkylidene diphosphonic acids described in U.S. Pat. Nos. 3,214,454 and 3794591, and German Patent Publication No. 2227639, etc., and compounds described in *Research Disclosure*, Vol. 181, Item 18170 (May issue, 1979).

Examples of the aminophosphonic acids include aminotris (methylenephosphonic acid), ethylenediaminetetramethylenephosphonic acid, aminotrimethylenephosphonic acid, and compounds described in *Research Disclosure*, Vol. 181, Item 18170, Japanese Laid-Open Patent Publication Nos. 57-208554, 54-61125, 55-29883, and 56-97347, etc.

Examples of the organic phosphonocarboxylic acids include compounds described in Japanese Laid-Open Patent Publication Nos. 52-102726, 53-42730, 54-121127, 55-4024, 55-4025, 55-126241, 55-65955, and 55-65956, and *Research Disclosure*, Vol. 181, Item 18170, etc. These chelating agents may be used in the state of an alkali metal salt or an ammonium salt.

The amount of the chelating agent per 1 L of the developer is preferably $1\times10^{4}$ to $1\times10^{11}$ mol, more preferably $1\times10^{-3}$ to $1\times10^{-2}$ mol.

The developer may contain a silver stain inhibitor, and examples thereof include compounds described in Japanese Laid-Open Patent Publication No. 56-24347, Japanese Patent Publication Nos. 56-46585 and 62-2849, and Japanese Laid-Open Patent Publication No. 4-362942. Further, the developer may contain a compound described in Japanese Laid-Open Patent Publication No. 61-267759 as a dissolution aid. Furthermore, the developer may contain a coloring agent, a surfactant, a defoaming agent, a film hardening agent, or the like, as needed. The development temperature and the development time are correlated, and are determined in relation to the overall treatment time. In general, the development temperature is preferably about 20° C. to 50° C., more preferably 25° C. to 45° C., and the development time is preferably 5 seconds to 2 minutes, more preferably 7 to 90 seconds.

It is also preferred that the developer is concentrated, and diluted at the practical use, from the viewpoints of costs for transporting the developer, costs for package materials, space saving, etc. Salt components in the developer may be effectively converted to the corresponding potassium salts in the case of concentrating the developer.

In the present invention, the development process may contain a fixation treatment for removing the silver salt in the unexposed area to stabilize the material. The fixation treatment may be carried out using common fixation technologies for silver salt photographic films, photographic papers, print engraving films, emulsion masks for photomasking, etc.

Preferred components of a fixer for the fixation treatment will be described below.

The fixer preferably contains sodium thiosulfate or ammonium thiosulfate, and may contain tartaric acid, citric acid, gluconic acid, boric acid, iminodiacetic acid, 5-sulfosalicylic acid, glucoheptanoic acid, a tiron, ethylenediaminetetraacetic acid, diethylenetriaminepentaacetic acid, nitrilotriacetic acid, a salt thereof, etc., if necessary. It is preferred that the fixer is free of boric acid in view of recent environmental protection. The fixer may contain sodium thiosulfate, ammonium thiosulfate, or the like as a fixing agent used in the present invention. The ammonium thiosulfate is preferred from the viewpoint of fixation rate, while the sodium thiosulfate may be preferably used in view of recent environmental protection. The amount of the known fixing agent may be appropriately controlled, and is generally about 0.1 to 2 mol/L, particularly preferably 0.2 to 1.5 mol/L. The fixer may contain a film hardening agent (such as a water-soluble aluminum compound), a preservative (such as a sulfite or bisulfite salt), a pH buffer (such as acetic acid), a pH regulator (such as ammonia or sulfuric acid), a chelating agent, a surfactant, a wetting agent, a fixing accelerator, etc., if necessary.

Examples of the surfactants include anionic surfactants such as sulfated products and sulfonated products, polyethylene surfactants, and amphoteric surfactants described in Japanese Laid-Open Patent Publication No. 57-6740. The fixer may contain a known defoaming agent.

Examples of the wetting agents include alkanolamines and alkylene glycols. Examples of the fixing accelerators include thiourea derivatives described in Japanese Patent Publication Nos. 45-35754, 58-122535, and 58-122536; alcohols having a triple bond; thioether compounds described in U.S. Pat. No. 4,126,459; and mesoionic compounds described in Japanese Laid-Open Patent Publication No. 4-229860. Compounds described in Japanese Laid-Open Patent Publication No. 2-44355 may be used as the fixing accelerator. Examples of the pH buffers include organic acids such as acetic acid, malic acid, succinic acid, tartaric acid, citric acid, oxalic acid, maleic acid, glycolic acid, and adipic acid, and inorganic buffers such as boric acid, phosphate salts, and sulfite salts. The pH buffer is preferably acetic acid, tartaric acid, or a sulfite salt. The pH buffer is used to prevent increase in the pH of the fixer due to incorporation of the developer, and the amount thereof is preferably about 0.01 to 1.0 mol/L, more preferably about 0.02 to 0.6 mol/L. The pH of the fixer is preferably 4.0 to 6.5, particularly preferably 4.5 to 6.0. Further, compounds described in Japanese Laid-Open Patent Publication No. 64-4739 may be used as a dye elution accelerator.

Examples of the film hardening agents for the fixer used in the present invention include water-soluble aluminum salts and chromium salts. The film hardening agent is preferably a water-soluble aluminum salt such as aluminum chloride, aluminum sulfate, or potassium alum. The amount of the film hardening agent added is preferably 0.01 to 0.2 mol/L, more preferably 0.03 to 0.08 mol/L.

In the fixation treatment, the fixation temperature is preferably about 20° C. to 50° C., more preferably 25° C. to 45° C. The fixation time is preferably 5 seconds to 1 minute, more preferably 7 to 50 seconds. The amount of the fixer is preferably 600 ml/$m^2$ or less, more preferably 500 ml/$m^2$ or less, particularly preferably 300 ml/$m^2$ or less, per the amount of the photosensitive material to be treated.

The developed and fixed photosensitive material is preferably subjected to a water washing treatment or a stabilization treatment. The amount of water used in the water washing treatment or stabilization treatment is generally 20 L or less, and 3 L or less may be supplied, per 1 $m^2$ of the photosensitive material. The photosensitive material may be washed with storage water, thus the amount of water supplied may be 0. Therefore, the treatment can be carried out without wasting water and without providing piping for an automatic processing. The multistage countercurrent method (for example, using two or three stages) has long been known as a method for reducing the amount of the washing water supplied. By using the multistage countercurrent method in the producing method of the present invention, the fixed photosensitive material is successively treated in the appropriate order with the treating liquid that is not contaminated with the fixer, so that the water washing treatment can be carried out more efficiently. In the case of using only a small amount of water in the treatment, it is further preferable to use a washing bath with a squeeze roller or a crossover roller described in Japanese Laid-Open Patent Publication Nos. 63-18350 and 62-287252, etc. Such a treatment using a small amount of water may be disadvantageous in high impact on environment, and thus an oxidant or filtration may be used to reduce the impact. Further, the treatment may be carried out such that an antifungal-treated water is introduced into a water washing bath or a stabilization bath according to the treatment, and the whole or part of the overflow liquid from the bath due to the water supply for the treatment is utilized for the fixing treatment liquid in the previous treatment, as described in Japanese Laid-Open Patent Publication No. 60-235133. Furthermore, a water-soluble surfactant or a defoaming agent may be added to the treatment liquid to prevent water bubble unevenness, which is easily caused in the treatment using a small amount of water, and/or to prevent a treatment component attached to the squeeze roller from being transferred to the treated film.

In the water washing treatment or stabilization treatment, a dye adsorbent described in Japanese Laid-Open Patent Publication No. 63-163456 may be disposed in the water washing bath to prevent contamination by a dye eluted from the photosensitive material. In the stabilization treatment subsequent to the water washing treatment, a bath containing a compound described in Japanese Laid-Open Patent Publication Nos. 2-201357, 2-132435, 1-102553, and 46-44446 may be used as a final bath for the photosensitive material. In this case, an ammonium compound, a compound of a metal such as Bi or Al, a fluorescent whitening agent, a chelating agent, a film pH regulator, a film hardening agent, a disinfecting agent, a fungicide, an alkanolamine, a surfactant, etc. may be added to the bath if necessary. The water used in the water washing or stabilization treatment may be a tap water, and is preferably a deionized water or a water sterilized with a halogen, an ultraviolet germicidal lamp, an oxidant such as ozone, hydrogen peroxide, or a chlorate salt, etc. Further, the washing water may contain a compound described in Japanese Laid-Open Patent Publication Nos. 4-39652 and 5-241309. In the water washing or stabilization treatment, the bath temperature and the treatment time are preferably 0° C. to 50° C. and 5 seconds to 2 minutes, respectively.

In the present invention, the treatment liquids such as the developer and the fixer are preferably stored in a packaging material with low oxygen permeability described in Japanese Laid-Open Patent Publication No. 61-73147. In the case of using a small amount of the treatment liquid supplied, evaporation and air oxidation of the liquid is preferably prevented by reducing the contact area between the liquid and air in the bath. Roller transport type automatic processors are described in U.S. Pat. Nos. 3,025,779 and 3545971, etc., and a roller transport type processor is herein described. In general, the roller transport type processor preferably conducts the four steps of development, fixation, water washing, and drying. Also in the present invention, the roller transport type processor most preferably conducts the four steps, though it may conduct another step such as a stop step. The four steps may include the stabilization step instead of the water washing step.

In the above steps, the components of the developer or the fixer other than water may be supplied in the solid state, and may be dissolved in the predetermined amount of water and then used as the developer or fixer. Such a treatment agent is referred to as a solid treatment agent. The solid treatment agent may be in a form of powder, tablet, granule, aggregate, or paste. The treatment agent is preferably in a tablet form or in a form described in Japanese Laid-Open Patent Publication No. 61-259921. The tablet may be prepared by a common method described in Japanese Laid-Open Patent Publication Nos. 51-61837, 54-155038, and 52-88025, UK Patent No. 1,213,808, etc. The granule treatment agent may be prepared by a common method described in Japanese Laid-Open Patent Publication Nos. 2-109042, 2-109043, 3-39735, and 3-39739, etc. The powder treatment agent may be prepared by a common method described in Japanese Laid-Open Patent Publication No. 54-133332, UK Patent Nos. 725,892 and 729,862, German Patent No. 3,733,861, etc.

The bulk density of the solid treatment agent is preferably 0.5 to 6.0 g/cm$^3$, particularly preferably 1.0 to 5.0 g/cm$^3$, in view of the solubility.

The solid treatment agent may be prepared such that at least two layers of granular components reactive with each other are separated by at least one intermediate layer of a substance unreactive with the reactive components in the treatment agent, the layer stack is wrapped in a packaging material capable of vacuum packaging, and gas in the packing material is removed to seal the material. The term "unreactive" used herein means that, when the substance is in contact with the reactive component, they are not reacted at all or reacted only slightly under ordinary conditions in the package. The unreactive substance may be any substance as long as it is unreactive with the two reactive components, and is inactive when the two reactive components are used for the purpose intended. The unreactive substance is used together with the two reactive components. For example, though hydroquinone and sodium hydroxide are reacted when they are in direct contact with each other in the developer, they can be stored in the vacuum packaging material for a long period by disposing a separator layer of sodium sulfite, etc. therebetween. Further, hydroquinone, etc. may be formed into a briquette to reduce the contact area with sodium hydroxide, thereby improving the storage stability. A bag composed of an unreactive plastic film or an unreactive laminate of a plastic substance and a metal foil may be used as the vacuum packaging material.

The ratio of the mass of the metallic silver contained in the exposed area after the development treatment to the mass of silver contained in this area before the exposure is preferably 50% by mass or more, more preferably 80% by mass or more. When the ratio is 50% by mass or more, a high conductivity can be preferably achieved.

In the present invention, a tone obtained by the development treatment is preferably more than 4.0, though not restrictive. When the tone after the development treatment is more than 4.0, the conductivity of the conductive metal portion can be increased while maintaining high transparency of the light transmittable portion. For example, the tone of 4.0 or more can be achieved by the above mentioned doping with rhodium or iridium ion.

—Physical Development Treatment—

In the present invention, it is also preferred that, to further increase the conductivity of the formed metallic silver portion, the photosensitive film is subjected to a physical development.

In the present invention, the physical development is such a process that a metal ion such as a silver ion is reduced by a reducing agent, whereby metal particles are deposited on a nucleus of a metal or metal compound. Such a physical development has been used in the fields of instant B & W film, instant slide film, printing, etc., and the technologies can be used in the present invention.

The physical development may be carried out at the same time as the above development treatment after the exposure, and may be carried out after the development treatment separately.

—Oxidation Treatment—

In the present invention, the fine metal particle portion formed by the development treatment and the conductive metal portion formed by the physical development and/or plating treatment are preferably subjected to an oxidation treatment. For example, in a case where a metal is deposited on the light transmittable portion, the metal can be removed by the oxidation treatment, so that the transmittance of the light transmittable portion can be increased to approximately 100%.

The oxidation treatment may be achieved by a known method using an oxidant such as Fe (III) ion. As described above, the oxidation treatment may be carried out after the exposure and development treatments of the emulsion layer, or after the physical development or the plating treatment, and may be carried out after the development treatment and after the physical development or plating treatment respectively.

In the present invention, the metallic silver portion may be treated with a Pd-containing solution after the exposure and development treatments. The Pd may be in the state of divalent palladium ion or metal palladium. The electroless plating or the physical development can be accelerated by this treatment.

In the light transmittable, electromagnetic-shielding material, the wire width of a mesh pattern portion is 1 to 40 μm, preferably 1 to 30 μm, most preferably 10 to 25 μm. The wire distance of the mesh pattern is preferably 50 to 500 μm, more preferably 200 to 400 μm, most preferably 250 to 350 μm. The mesh pattern portion may have a part with a wire width of more than 20 μm for the purpose of ground connection, etc.

A frame portion of a conductive metal is formed along the periphery of the light transmittable conductive film, and is electrically connected to the mesh pattern portion. The width of the frame portion is preferably 1 mm to 10 cm, more preferably 5 mm to 5 cm.

In the present invention, the aperture ratio of the conductive metal portion is preferably 85% or more, more preferably 90% or more, most preferably 95% or more, in view of the visible light transmittance. The aperture ratio is a ratio of a portion not having fine wires forming the mesh to the whole area of the conductive metal portion. For example, a square lattice mesh having a wire width of 15 μm and a pitch of 300 μm has an aperture ratio of 90%.

—Visible Light Transmittable Portion—

In the present invention, the visible light transmittable portion is a portion having transparency, other than the conductive metal portion in the light transmittable conductive film. The transmittance of the visible light transmittable portion, which is herein a minimum transmittance value in a wavelength region of 380 to 780 nm, obtained neglecting the light absorption and reflection of the support, is 90% or more, preferably 95% or more, more preferably 97% or more, further preferably 98% or more, most preferably 99% or more.

In the present invention, the mesh pattern preferably has a continuous structure with a length of 3 m or more. As the length of the continuous structure is increased, the loss of producing an optical filter material can be preferably reduced. The length of the continuous structure is preferably 2000 m or less. When the mesh pattern having a length of more than 2000 m is formed into a roll, the roll is disadvantageous in large diameter, heavy weight, and that high pressure is applied to the roll center to cause adhesion or deformation, etc. The length is more preferably 100 to 1000 m, further preferably 200 to 800 m, most preferably 300 to 500 m.

For a similar reason, the thickness of the support is preferably 200 μm or less, more preferably 20 to 180 μm, most preferably 50 to 120 μm.

In the present invention, the mesh pattern is a so-called lattice pattern containing crossed linear fine wires. The adjacent wires are substantially parallel to each other within an error of plus or minus 2°.

The scanning with the optical beam is preferably carried out by exposure using light sources arranged on a line in a direction substantially perpendicular to the conveying direction, or using a rotary polygon mirror. In this case, the optical beam has to undergo binary or more intensity modulation, and dots are continuously formed into a line pattern. Because each fine wire comprises continuous dots, a fine 1-dot wire has a steplike shape. The width of each fine wire is a length in the narrowest part.

It is also preferred that the direction of scanning with the optical beam is tilted against the conveying direction according to the tilt of the lattice pattern, to form the mesh portion. In this case, two optical beams for scanning are preferably orthogonal to each other, and the beams have substantially mono intensity on the exposed surface. Slit exposure or mask exposure may be used to expose the frame portion.

In the present invention, the mesh pattern is tilted preferably at 30° to 60°, more preferably at 40° to 50°, most preferably at 43° to 47°, against the conveying direction. In general, it is difficult to prepare a mask for tilting the mesh pattern at about 45° against the frame, and this is likely to result in uneven pattern or increased cost. However, in the above method, such an uneven pattern is hardly formed at the tilt angle of around 45°. Thus, the present invention is more effective in the case of using the method, as compared with the case of using masking exposure photolithography or screen printing.

In the above embodiment, the conductive metal portion is formed by exposing and developing the photosensitive material having the silver salt emulsion layer containing the silver halide. The present invention is not limited to the above embodiment, and the conductive metal portion may be formed by a photolithography method containing an etching process. For example, the conductive metal portion may be formed such that the entire surface of the photosensitive material is exposed to uniformly form the developed silver, and a photopolymer for photolithography is applied thereto, exposed, and etched. The methods may be carried out using technologies described in Japanese Laid-Open Patent Publication Nos. 2003-46293, 2003-23290, 5-16281, and 10-338848, etc.

(III) Step of Electrifying Base Material to be Plated

[Electrification Step]

The producing method of the present invention contains the electrification step of electrifying the base material to be plated in the electrolytic solution substantially free of plating substances, while using the conductive metal portion as a cathode.

In the electrification step, the conductive metal portion is reduced, and thus the plating activity of the conductive metal portion is increased. Particularly in the case of using the developed silver or the silver-containing fine particles derived from the fine silver particle ink or paste as the conductive metal, the base material can be rapidly plated with high plating activity without plating fog.

The electrification method and the electrolytic solution free of plating substances will be described in detail below.

[Electrification Method]

In the electrification step of the present invention, a metal electrode is brought into contact with the conductive metal portion on the support, and the electricity is applied to the portion.

In view of conveying the base material to be plated, the metal electrode is preferably a feed roller composed of a metal, and the diameter of the feed roller is preferably 1 to 20 cm. The hydrogen overvoltage of the metal feed roller is preferably higher than that of the base material to be plated. The hydrogen overvoltage is represented by an absolute value obtained from 0 V vs. NHE.

The base material to be plated is conveyed from the feed roller to the electrolytic solution, hereinafter described in detail, and the base material is electrified in the electrolytic solution. The distance between the feed roller and the electrolytic solution may be controlled in view of the resistance value of the base material to be plated, etc. In a case where the base material to be plated has a high resistance, the feed roller is preferably closer to the electrolytic solution, and the distance therebetween is preferably 0.5 to 30 cm.

In a case where the base material to be plated has an extremely high resistance or the pattern is not continuous, the base material cannot be sufficiently electrified in the electrolytic solution by the current form the roller disposed above the solution occasionally. In this case, the feed roller may be immersed in the electrolytic solution to achieve the advantageous effects of the present invention. Also when the feed roller is immersed in the electrolytic solution, electric current loss due to hydrogen generation can be reduced by using, for the feed roller, a material having a hydrogen overvoltage higher than that of the base material. When the conductive metal portion is composed of silver, the feed roller is preferably composed of nickel, copper, cadmium, tin, lead, or zinc, and may be composed of an alloy to increase the hydrogen overvoltage.

When the distance between the base material to be plated in the electrolytic solution and the counter electrode (an anode) is uniform in the width direction, the plating activity can be increased more uniformly.

When the electric current for the electrification is excessively small, the plating activity cannot be improved. When the current is excessively large, the base material becomes deactivated. Thus, the current is preferably 0.001 to 10 $A/dm^2$, more preferably 0.005 to 5 $A/dm^2$, particularly preferably 0.01 to 1 $A/dm^2$.

When the electrification time is excessively short, the electroless plating activity cannot be improved. When the electrification time is excessively long, the base material is deactivated. Thus, the time is preferably 0.1 to 360 seconds, more preferably 0.5 to 120 seconds, most preferably 1 to 60 seconds.

[Electrolytic Solution Substantially Free of Plating Substances]

In the present invention, the term "the electrolytic solution free of plating substances" means an electrolytic liquid in which a plated layer having a predetermined thickness is substantially not formed on the base material by a plating reaction. Specifically, when an electric current is applied to the base material at 1 $A/dm^2$ for 60 seconds, the amount of a substance deposited on the electrode from the electrolytic solution is 10 $mg/dm^2$ or less, preferably 1 $mg/dm^2$ or less.

In the present invention, the electrolytic solution preferably contains an electrolyte to reduce the solution resistance between the positive electrode and the negative electrode.

Examples of the electrolytes include alkali metal salts, ammonium salts, perchlorate salts, and borate salts. The electrolyte is preferably sodium sulfate, potassium nitrate, ammonium sulfate, boric acid, sodium perchlorate, sodium p-toluenesulfonate, or the like, particularly preferably sodium sulfate.

The solvent of the electrolytic solution may contain water or a nonaqueous solvent (or a nonaqueous organic solvent), and is most preferably water (pure water). Examples of the nonaqueous organic solvents include amides, pyrolidones, nitrites, ketones, and tetrahydrofuran. Specifically, the amides include dimethylformamide, N-methylformamide, and N-methylacetamide, the pyrolidones include N-methylpyrolidone, the nitrites include acetonitrile, propionitrile, and benzonitrile, the ketones include acetone, methyl ethyl ketone, methyl isobutyl ketone, and acetylacetone.

The electrolyte concentration of the solution is preferably $10^{-3}$ to 3 mol/L, more preferably $10^{-3}$ to 1 mol/L, most preferably $10^{-2}$ to 0.5 mol/L. The electrolyte concentration may be appropriately controlled depending on the surface resistance of the base material to be plated, the electrification time, the distance between electrodes (between the base material to be plated and the counter anode), etc. When the electrolyte concentration is less than $10^{-3}$ mol/L, the solution resistance between the positive electrode and the negative electrode is increased, a voltage required for applying a predetermined current is increased, and it is difficult to achieve the advantageous effects of the present invention. When the electrolyte concentration is more than 3 mol/L, the electrolyte may undesirably be deposited on the base material to be plated.

[Plating Step]

The producing method of the present invention contains the plating step of subjecting the fine metal particle portion to a plating treatment. In this step, the conductivity of the fine metal particle portion is increased to form the conductive material according to the present invention.

The plating step preferably contains an electroless plating treatment and an electroplating treatment. It is more preferred that an electroless plating treatment and an electroplating treatment are carried out in this order, and it is particularly preferred that an electroless plating treatment, a copper electroplating treatment, and a black electroplating treatment are carried out in this order.

The electroless plating treatment and the electroplating treatment will be described in detail below.

[Electroless Plating Treatment]

In the present invention, copper, nickel, chromium, zinc, tin, gold, platinum, or silver may be used as an electroless plating metal in the electroless plating treatment. It is preferred that copper is used as the plating metal from the viewpoints of conductivity and plating stability.

The electroless plating time is preferably 15 seconds to 10 minutes, more preferably 30 seconds to 8 minutes, further preferably 1 to 7 minutes. When the electroless plating time is more than 10 minutes, the transparency of the light transmittable portion is remarkably reduced. The reduction seems to be caused such that a gelatin film is immersed in a high alkali bath for a long time and thereby deteriorated. When the electroless plating time is less than 30 seconds, the resultant material has insufficient conductivity or uneven plated layer thickness.

The electroless plating temperature is preferably 10° C. to 50° C., more preferably 15° C. to 40° C.

The electroless plating solution for the treatment is preferably aerated continuously or stepwise. The amount of the air for the aeration is preferably 0.01 to 10 liter per solution liter per minute, more preferably 0.05 to 3 liter per solution liter per minute, further preferably 0.2 to 0.5 liter per solution liter per minute. It is preferred that a larger amount of air is used to stir the solution more vigorously, thereby improving uniformity. However, when the amount is excessively large, the pH of the solution is lowered by blown $CO_2$, and a large amount of an alkali is required to correct the pH.

A copper plating solution for an electroless copper plating treatment will be described below.

[Electroless Copper Plating Solution]

Examples of chemical species contained in the electroless copper plating solution include copper sulfate, copper chloride, and the like; reducing agents such as formalin and glyoxylic acid; copper ion complexing agents such as EDTA, tartaric acid, triisopropanolamine, triethanolamine, and nitrilotriacetic acid; and additives for stabilizing the bath or improving smoothness of a plated film, such as polyethylene glycol, yellow prussiate of potash, bipyridine, and thiourea compounds. Triethanolamine is preferably used as a copper ion complexing agent in rapid plating.

The additive for stabilizing the bath is more preferably a sulfur-containing compound. The amount of the bath stabilizing additive is preferably $1\times10^{-9}$ to $1\times10^{-4}$ mol/L, more preferably $1\times10^{-8}$ to $1\times10^{-6}$ mol/L. The concentration of the copper ion is preferably 0.001 to 0.3 mol/L, more preferably 0.005 to 0.1 mol/L, further preferably 0.01 to 0.1 mol/L. The concentration of the copper ion complexing agent is preferably 0.5 to 10 times, more preferably 0.7 to 7 times, further preferably 0.8 to 4 times the copper ion concentration, by mol/L. The concentration of the reducing agent is preferably 0.001 to 1 mol/L, more preferably 0.01 to 1 mol/L, further preferably 0.1 to 0.7 mol/L, in view of achieving satisfactory plating solution stability and plating rate.

[Electroplating Treatment]

The producing method of the present invention preferably contains an electroplating treatment, and more preferably contains a copper electroplating treatment and a black electroplating treatment. The time for each plating treatment may be changed depending on the plating metal, plating thickness, plating quality, etc. In general, the plating treatment time is preferably 10 seconds to 120 minutes, particularly preferably 1 to 60 minutes. The voltage applied in the treatment is preferably 0.1 to 100 V, particularly preferably 0.5 to 30 V, most preferably 0.5 to 20V.

A commercially available or known electroplating solution may be used for the electroplating treatment. A copper electroplating solution and a black electroplating solution usable in the method of the present invention will be described below.

[Copper Electroplating Solution]

The copper electroplating solution contains at least one copper source compound, and examples thereof include copper sulfate, copper cyanide, copper borofluoride, copper chloride, copper pyrophosphate, and copper carbonate. It is preferred that copper sulfate is used for the copper electroplating solution from the viewpoints of costs for preparing a plating bath, manageability, etc. It is more preferred that a copper sulfate pentahydrate salt or an aqueous copper sulfate solution prepared beforehand is used for the copper electroplating solution.

The copper ion concentration of the copper plating solution is preferably 150 to 300 g/L, more preferably 150 to 250 g/L, further preferably 180 to 220 g/L, based on the mass of the equivalent copper sulfate pentahydrate salt.

The temperature of the copper electroplating solution is preferably 15° C. to 35° C., more preferably 20° C. to 30° C. The copper electroplating solution is preferably stirred by a known method such as an air stirring method, a jet stirring method of spraying the solution from a small nozzle, or a stirring method of circulating a tank liquid.

An acid may be added to the copper electroplating solution. The acid for the plating solution is not particularly limited as long as the plating solution has a sufficiently low pH. The acid may be sulfuric acid, nitric acid, hydrochloric acid, etc., and is preferably sulfuric acid. The pH of the plating solution is changed depending on the concentration of the acid, and is preferably 3 or lower, more preferably 1 or lower. When the pH of such an acidic copper plating solution is more than 3, the copper is easily deposited, disadvantageously.

Various additives may be added to the copper electroplating solution for the purpose of accelerating the plating reaction, thereby shortening the plating time, or the purpose of inhibiting the plating reaction or flattening the plated layer, thereby achieving more uniform plating, etc. Typical examples of the additives for the copper electroplating solution include chlorine ions, polyalkylene glycols, sulfur-containing organic compounds, and nitrogen-containing compounds. These compounds may be used in combination. The concentration of the chlorine ion additive is preferably 20 to 150 mg/L, more preferably 30 to 100 mg/L.

Specific examples of the polyalkylene glycols include polyethylene glycols, polypropylene glycols, polyethylene glycol/polypropylene glycol block copolymer-type surfactants (Pluronic-type surfactants), polyethylene glycol/polypropylene glycol graft copolymer-type surfactants (Tetronic-type surfactants), glycerin ethers, and dialkyl ethers. The polyalkylene glycol is preferably a polyethylene glycol having a molecular weight of 1000 to 10000, more preferably 2000 to 6000, a polypropylene glycol having a molecular weight of 100 to 5000, more preferably 200 to 2000, or an ethylene glycol/propylene glycol block copolymer containing a polyethylene glycol having a molecular weight of 1000 to 10000, more preferably 1500 to 4000. The polyalkylene glycol is most preferably a polyethylene glycol having a molecular weight of 2000 to 6000. These compounds may be used singly or in combination of two or more. The total concentration of the polyalkylene glycols is preferably 10 to 5000 mg/L, more preferably 50 to 2000 mg/L.

Specific examples of the sulfur-containing organic compounds include bis(3-sulfopropyl) disulfide (SPS) and mercaptopropanesulfonic acid sodium salt (MPS). Further, compounds described in Japanese Laid-Open Patent Publication No. 7-316875, Paragraph [0012], and sulfur-containing amino acids such as methionine may be preferably used as the sulfur-containing organic compound. The sulfur-containing organic compounds may be used singly or in combination of two or more. The concentration of the sulfur-containing organic compound is preferably 0.01 to 5000 mg/L, more preferably 0.02 to 2000 mg/L, further preferably 0.1 to 300 mg/L.

Examples of the nitrogen-containing compounds include polyalkyleneimines, 1-hydroxyethyl-2-alkylimidazoline salts, polydialkylaminoethyl acrylate quaternary salts, polyvinylpyridine quaternary salts, polyvinylamidines, polyallylamines, polyaminesulfonic acids, auramine and derivatives thereof, methyl violet and derivatives thereof, crystal violet and derivatives thereof, janus black and derivatives thereof, and janus green. The nitrogen compounds may be used singly or in combination of two or more. The concentration of the nitrogen-containing compound is preferably 0.1 to 1000 mg/L, more preferably 0.5 to 150 mg/L.

[Black Electroplating Solution]

The black electroplating solution generally contains at least two metal elements of nickel, zinc, tin, copper, cobalt, etc. The combination of nickel-zinc or nickel-tin is preferably used in the plating solution in view of electrodeposition property and/or color of the plated layer, etc. A plurality of plated layers may be formed by using a plurality of plating solutions. In this case, the plating solutions may contain the same two elements (e.g., the same nickel compound and zinc compound) and have different composition ratios of the nickel compound and/or the zinc compound. Alternatively, the plating solutions may contain different two elements. In the case of forming such a plurality of plated layers, a multistage unit having two or more baths may be used as a plating unit to be hereinafter described.

Examples of source compounds for the metals include salts such as sulfates, nitrates, chlorides, ammonium sulfates, sulfamates, and pyrophosphates. The concentration of the source compound is preferably 50 to 250 g/L, more preferably 80 to 180 g/L, based on the mass of the equivalent nickel sulfate hexahydrate salt. A completing agent for accelerating dissolution of the metal source compound or for increasing the stability of the plating solution, an additive for controlling plating property described in terms of the copper electroplating solution, a buffer for reducing pH change of the plating solution such as succinic acid or citric acid, etc. may be added to the black electroplating solution.

The temperature of a black nickel electroplating solution is preferably 30° C. to 60° C., more preferably 35° C. to 50° C. The black electroplating solution may be stirred by a method such as air stirring, jet stirring, or tank circulation, in the same manner as the copper electroplating solution.

[Conductive Functional Layer Having Conductive Metal Portion, Electroless Plated Layer, Electroplated Layer]

The conductive functional layer, which contains the conductive metal portion, electroless plated layer, and electroplated layer formed in the above treatments, has a mesh pattern portion and a frame portion. The mesh pattern portion contains fine wires having widths of 1 to 40 μm. In the case of using the conductive material for a light transmittable, electromagnetic-shielding material, the mesh pattern portion preferably has a geometric shape of a combination of triangle (e.g., equilateral triangle, isosceles triangle, right triangle), quadrangle (e.g., square, rectangle, rhombus, parallelogram, trapezoid), (regular) n-gon (e.g., (regular) hexagon, (regular) octagon), circle, ellipse, star, etc. The mesh pattern portion more preferably has a mesh shape containing the geometric shape. From the viewpoint of electromagnetic-shielding property, the triangular shape is most effective. From the viewpoint of visible light transmittance, a shape of (regular) n-gon with larger n is more effective. As the value n is increased, the aperture ratio and the visible light transmittance are advantageously increased, assuming that every shape has the same line width. From the viewpoint of preventing moiré, it is also preferred that the geometric shapes are arranged randomly, or the line width is changed non-periodically. Further, the mesh pattern portion preferably contains crossed linear fine wires, substantially parallel to each other.

The surface resistance of the conductive metal portion is preferably 10 to 10000 Ω/sq before the electrification treatment, and the surface resistance of the conductive functional layer stack is preferably 0.01 to 1 Ω/sq.

In the case of using the conductive material for a conductive wire material, the shape of the mesh pattern portion is not particularly limited, and may be appropriately selected in accordance with the intended use.

A conductive material 10 according to an embodiment of the present invention, produced as described above, is shown in FIG. 1. The conductive material 10 shown in FIG. 1 has a transparent support 12, and has a conductive functional layer 14 and a light transmittable portion 18 of gelatin or the like formed on the support 12. A conductive metal portion 16 is formed by exposing and developing a silver halide emulsion layer. The conductive functional layer 14 contains a first plated layer 20, a second plated layer 22, and a third plated layer 23, formed in this order on the conductive metal portion 16. For example, the first plated layer 20 may be formed by a electroless Cu (copper) plating treatment, the second plated layer 22 may be formed by a Cu (copper) electroplating treatment, and the third plated layer 23 may be formed by an Ni (nickel)-zinc black electroplating treatment.

A method for producing the conductive material 10 will be described with reference to FIGS. 2A to 3D.

Figure 2A:
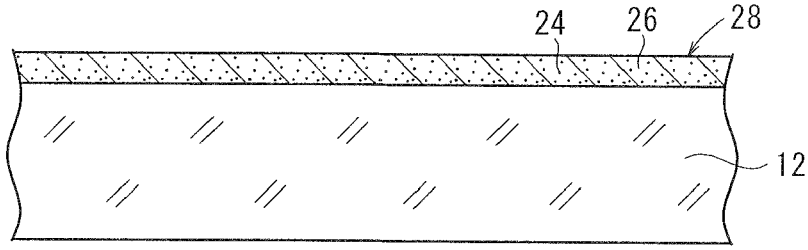
FIG. 2A is a view showing the step of forming a silver halide emulsion layer on a transparent support.

First, as shown in FIG. 2A, the transparent support 12 is coated with a silver halide emulsion layer 28, which is formed by mixing a silver halide 24 (e.g., silver bromide particles, silver chlorobromide particles, silver iodobromide particles) with a gelatin 26. Though the silver halide 24 is exaggerated as particles in FIGS. 2A to 2C to easy understanding, the size, concentration, etc. of the silver halide 24 are not limited to the drawings.

Figure 2B:
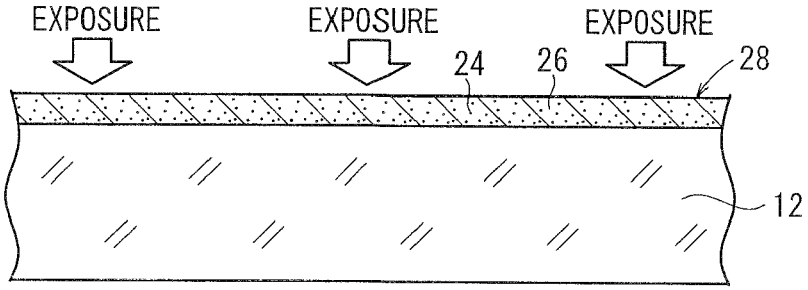
FIG. 2B is a view showing the step of locally exposing the silver halide emulsion layer.

Then, as shown in FIG. 2B, the silver halide emulsion layer 28 is subjected to an exposure treatment for forming a mesh pattern, etc. When an optical energy is applied to the silver halide 24, a minute silver nucleus (a latent image), invisible to the naked eye, is generated.

Figure 2C:
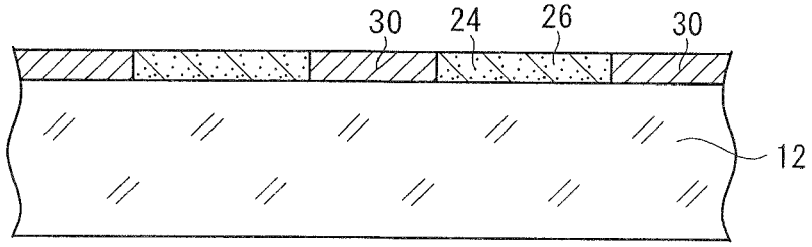
FIG. 2C is a view showing the step of a development treatment.

As shown in FIG. 2C, a development treatment is carried out to convert the latent image to an image visible to the naked eye. Specifically, the silver halide emulsion layer 28 having the latent image is developed using a developer, which is an alkaline or acidic solution, generally an alkaline solution. In the development treatment, using the latent image silver nucleus as a catalyst core, the silver halide or silver ion from the developer is reduced to metallic silver by a reducing agent, that is called a developing agent, in the developer. As a result, the latent image silver nucleus is grown to form a visible silver image (a developed silver 30).

Figure 2D:
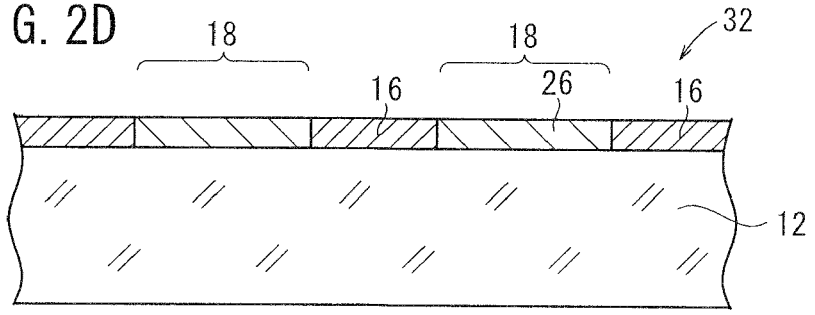
FIG. 2D is a view showing the step of a fixation treatment.

The photosensitive silver halide 24 remains in the silver halide emulsion layer 28 after the development treatment. As shown in FIG. 2D, the silver halide 24 is removed by a fixation treatment using a fixer, which is an acidic or alkaline solution, generally an acidic solution.

After the fixation treatment, the conductive metal portion (metallic silver portion) 16 is disposed in an exposed area, and only the gelatin 26 remains in an unexposed area as the light transmittable portion 18. Thus, the combination of the metallic silver portion 16 and the light transmittable portion 18 is formed on the transparent support 12, so that a base material to be plated 32 having the metallic silver portion 16 is prepared.

In a case where silver bromide is used as the silver halide 24 and a thiosulfate salt is used in the fixation treatment, a reaction represented by the following formula proceeds in the fixation treatment.

$$AgBr\ (solid)+2S_2O_3\ ions \rightarrow Ag(S_2O_3)_2\ (readily\text{-}water\text{-}soluble\ complex)$$

2 thiosulfate $S_2O_3$ ions and a silver ion in the gelatin 26 (a silver ion from AgBr) are reacted to generate a thiosulfate complex. The thiosulfate complex has high water solubility, and thereby is eluted from the gelatin 26. As a result, the developed silver 30 is fixed as the metallic silver portion 16.

Thus, the latent image is reacted with the reducing agent to deposit the developed silver 30 in the development step, and the residual silver halide 24, not converted to the developed silver 30, is eluted into water in the fixation step. The steps are described in detail in T. H. James, "*The Theory of the Photographic Process, 4th ed.*", Macmillian Publishing Co., Inc., NY, Chapter 15, pp. 438-442, 1977.

An alkaline solution is generally used in the development treatment. Therefore, when the process goes to the fixation treatment from the development treatment, the alkaline solution used in the development treatment may be mixed into the fixer (generally an acidic solution) for the fixation treatment, whereby the activity of the fixer may be disadvantageously changed. Further, the developer may remain on the film after removing the film from the development bath, whereby an undesired development reaction may be accelerated by the developer. Thus, it is preferred that the silver halide emulsion layer 28 is neutralized or acidified by a quencher such as an acetic acid solution after the development treatment before the fixation treatment.

Figure 3A:
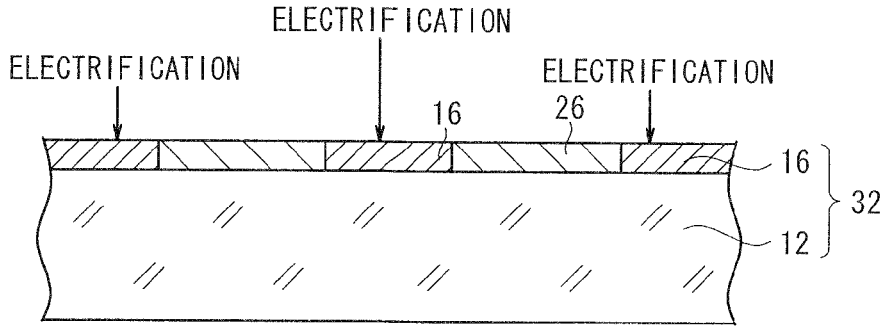
FIG. 3A is a view showing the step of an electrification treatment.

Then, as shown in FIG. 3A, the base material to be plated 32 is electrified in an electrolytic solution free of plating substances, using the metallic silver portion 16 as a cathode.

Figure 3B:
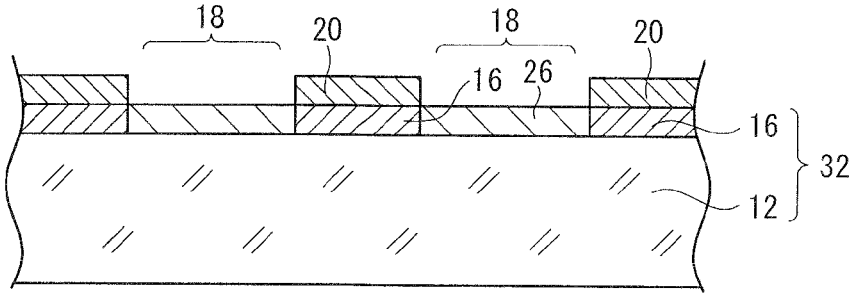
FIG. 3B is a view showing the step of an electroless plating treatment.

After the electrification, as shown in FIG. 3B, the base material 32 is subjected to an electroless plating treatment to form the first plated layer 20 only on the metallic silver portion 16.

Figure 3C:
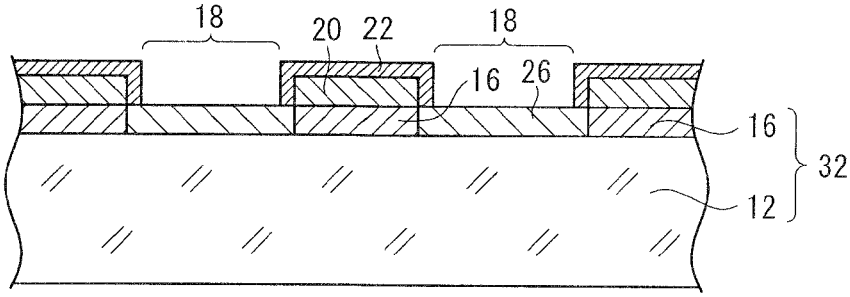
FIG. 3C is a view showing the step of a copper plating treatment.

Next, as shown in FIG. 3C, the base material 32 is subjected to a copper electroplating treatment to form the second plated layer 22 on the first plated layer 20.

Figure 3D:
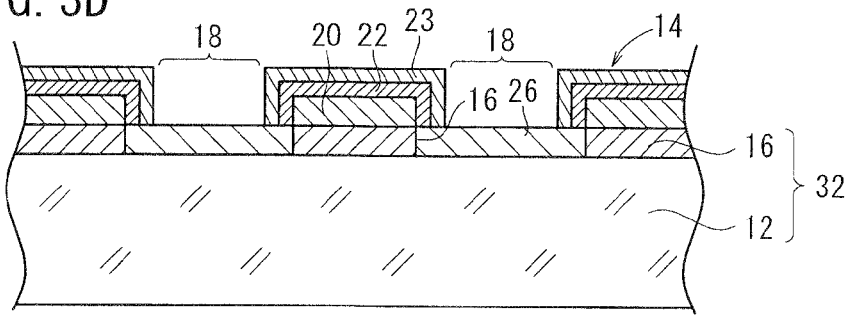
FIG. 3D is a view showing the step of a black electroplating treatment.

Further, as shown in FIG. 3D, the base material 32 is subjected to a black electroplating treatment to form the third plated layer 23 on the second plated layer 22. Thus, the conductive functional layer is formed on the transparent support 12 as shown in FIG. 1. An easy adhesion layer may be formed on the other surface of the transparent support 12.

Difference between the above mentioned method using the silver halide emulsion layer 28 (a silver salt photography technology) and a method using a photoresist (a resist technology) is described below.

In the resist technology, a photopolymerization initiator absorbs a light in an exposure treatment to initiate a reaction, a photoresist film (a resin) per se undergoes a polymerization reaction to increase or decrease solubility in a developer, and the resin in an exposed area or an unexposed area is removed in a development treatment. The developer used in the resist technology may be, for example, an alkaline solution free of reducing agents, in which an unreacted resin component can be dissolved. On the other hand, as described above, in the silver salt photography technology according to the present invention, the minute silver nucleus, the so-called latent image, is formed from silver ion and photoelectron generated in the exposed silver halide 24 in the exposure treatment. The latent image silver nucleus is grown to form the visible silver image in the development treatment using the developer, which must contain the reducing agent (the developing agent). Thus, the resist technology and the silver salt photography technology are greatly different in the reactions in the exposure treatments and the development treatments.

In the development treatment of the resist technology, the unpolymerized resin portion in the exposed or unexposed area is removed. On the other hand, in the development treatment of the silver salt photography technology, using the latent image as the catalyst core, the reduction reaction is conducted by the reducing agent (the developing agent) contained in the developer, and the developed silver 30 is grown into a visible size. The gelatin 26 in the unexposed area is not removed in the silver salt photography technology. Thus, the resist technology and the silver salt photography technology are greatly different also in the reactions in the development treatments.

The silver halide 24 contained in the gelatin 26 in the unexposed area is eluted in the following fixation treatment, and the gelatin 26 is not removed (see FIG. 2D).

As described above, the main reaction component (the photosensitive component) is the silver halide 24 in the silver salt photography technology, while it is the photopolymerization initiator in the resist technology. Further, in the development treatment, the binder (the gelatin 26) is present in the silver salt photography technology (see FIG. 2D), while it is removed in the resist technology. The resist technology and the silver salt photography technology are greatly different in these points.

<Apparatus for Producing Conductive Material>

The apparatus of the present invention for producing a conductive material has an electrifying bath for electrifying the base material to be plated in the electrolytic solution free of plating substances, using the metallic silver portion 16 as a negative electrode (a cathode), and has a plating bath. The apparatus preferably has an electroless plating bath, a copper electroplating bath, and a black electroplating bath.

Figure 4:
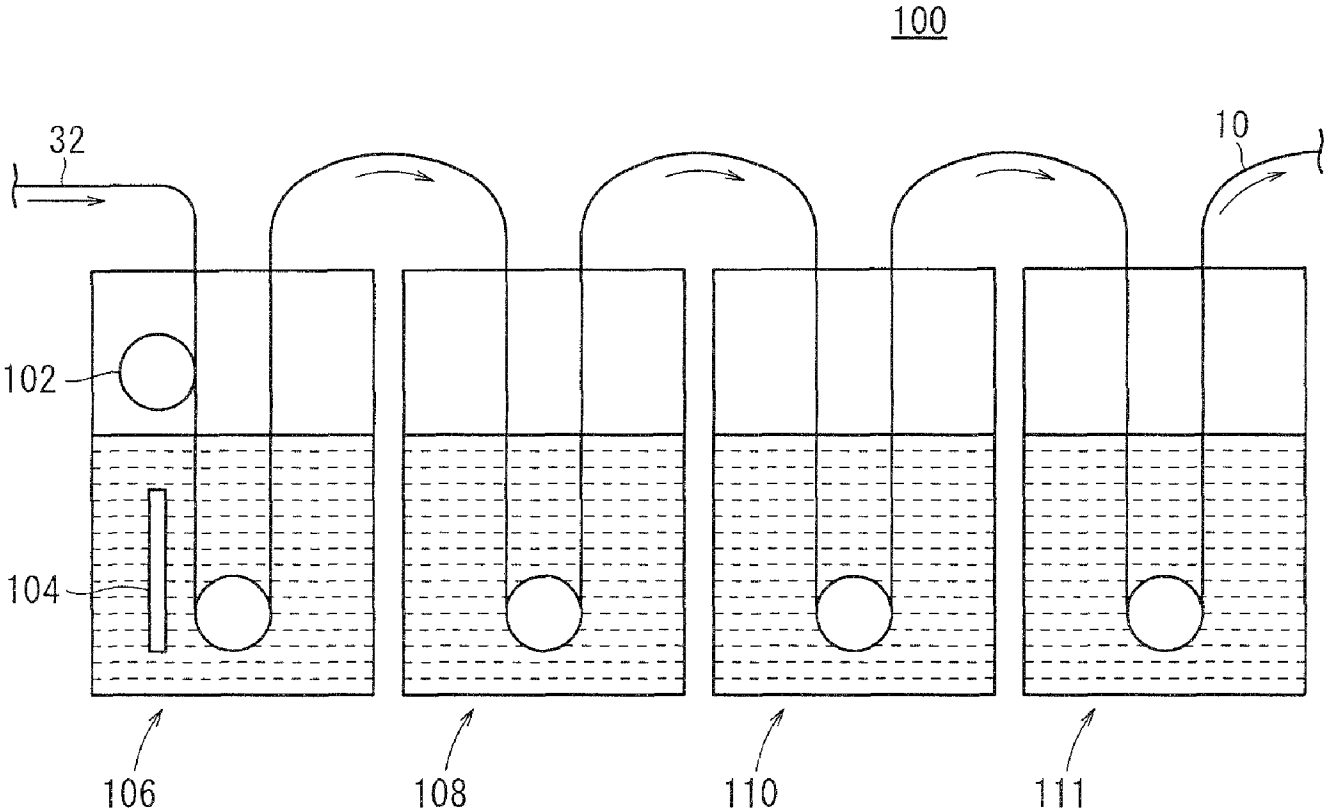
FIG. 4 is an explanatory schematic view showing an apparatus for producing a conductive material according to an embodiment of the present invention.

As shown in FIG. 4, a producing apparatus 100 according to the embodiment may be such that an electrifying unit 106 having a metal feed roller (a first feed roller) 102 and an electrode (an anode) 104, an electroless plating treatment section 108, a copper electroplating treatment section 110, and a black electroplating treatment section 111 are disposed in this order in the direction of conveying the base material 32, whereby the base material 32 is subjected to an electrification treatment, an electroless plating treatment, a copper electroplating treatment, and a black electroplating treatment in this order. Though one bath is used for one treatment in FIG. 4 to simplify the explanation, a plurality of baths may be used for each treatment in accordance with the purpose.

The electrifying unit 106, the electroless plating treatment section 108, the copper electroplating treatment section 110, and the black electroplating treatment section 111 will be described in detail below.

[Electrifying Unit 106]

In the electrifying unit 106 according to this embodiment, the base material to be plated 32, which is exposed and developed to form the fine-wire metallic silver portion 16, is electrified, so that the metallic silver portion 16 is reduced and activated.

Figure 5:
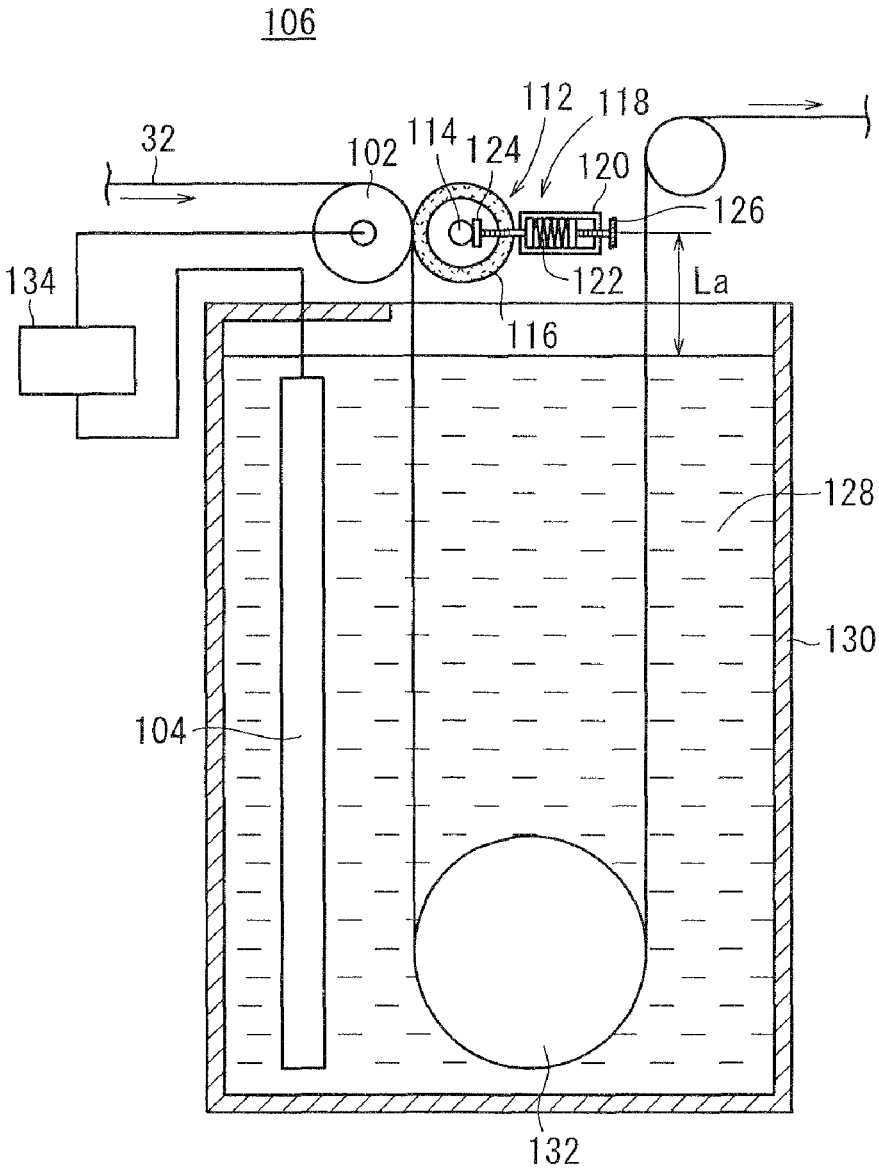
FIG. 5 is a schematic view showing an electrifying unit, preferably used in the apparatus according to the embodiment.

Specifically, as shown in FIG. 5, the electrifying unit 106 has the first feed roller 102, which is brought into contact with the metallic silver portion 16 of the base material to be plated 32 and applies electricity to the metallic silver portion 16. An elastic roller 112 for pressing the metallic silver portion 16 of the base material to be plated 32 to the first feed roller 102 is disposed on substantially the same level as the first feed roller 102 with the base material 32 in-between.

The elastic roller 112 has a rotatably supported shaft 114 and a surface elastic layer 116. The elastic layer 116 is composed of a urethane rubber, etc. A pressing device 118 is disposed on each end of the shaft 114 in the elastic roller 112 such that the rotation of the shaft 114 is not inhibited by the pressing device 118. The pressing device 118 has a casing 120 and a spring 122 disposed therein. A contact member 124 is pressed toward the shaft 114 by the spring 122 and abutted against the shaft 114. The back side of the spring 122 is in contact with an adjusting screw 126 disposed on the casing 120. A force for pressing the base material to be plated 32 to the first feed roller 102 can be changed by controlling the engaging position of the adjusting screw 126.

The electrifying unit 106 has an electrifying bath 130 filled with an electrolytic solution 128, disposed downstream of the first feed roller 102 in the direction of conveying the base material to be plated 32.

The electrolytic solution 128 is free of plating substances. The term "free of plating substances" means that plating reactions are substantially not caused in the liquid. When an electric current is applied to the base material 32 at 1 A/dm$^2$ for 60 seconds, the amount of a substance deposited on the electrode from the electrolytic solution 128 is preferably 10 mg/dm$^2$ or less, more preferably 1 mg/dm$^2$ or less.

In the electrifying unit 106, the base material to be plated 32 is conveyed by an in-liquid roller 132 in the electrolytic solution 128 of the electrifying bath 130, while the metallic silver portion 16 being in contact with the first feed roller 102. Electricity is applied by a direct-current power source 134 to the cathode of the first feed roller 102 as the cathode and the anode 104 placed in the electrolytic solution 128 of the electrifying bath 130. Thus, the base material to be plated 32 is electrified to reduce the metallic silver portion 16. An oxide or the like generated on the metallic silver portion 16 of the base material to be plated 32 is removed (for example, $Ag_2O$ or $Ag_2S$ is reduced to Ag) by the electrification, so that the metallic silver portion 16 is activated. The plating rate in the following electroless plating treatment can be increased by such an electrification treatment.

The first feed roller 102 preferably has a metal electrode. The diameter of the first feed roller 102 is preferably 1 to 20 cm, particularly preferably 2 to 10 cm. The distance between the first feed roller 102 and the electrolytic solution 128 is preferably 5 mm to 30 cm, particularly preferably 1 to 5 cm. When these values are within the ranges, the distance La between the electrolytic solution 128 and the contact point of the base material 32 and the first feed roller 102 can be reduced, whereby the metallic silver portion 16 of the base material 32 can be prevented from being oxidized before the base material 32 is immersed in the electrolytic solution 128. In a particularly preferred embodiment, the distance between the first feed roller 102 and the electrolytic solution 128 may be less than 1 cm, the first feed roller 102 may be placed on the surface of the electrolytic solution 128, or alternatively the first feed roller 102 may be placed in the electrolytic solution 128. In this embodiment, the oxidization of the metallic silver portion 16 of the base material to be plated 32 can be more effectively prevented after electrifying the base material 32.

The surface roughness of the first feed roller 102 is preferably 1 to 50 μm, particularly preferably 2 to 20 μm, in view of holding and scratching of the base material to be plated 32.

By electrification treatment using the electrifying unit 106, the surface to be plated of the metallic silver portion 16 on the base material 32 is activated in this manner. Thus, the following plating treatments can be rapidly carried out without plating fog, whereby the conductive material can be mass-produced.

The electrifying unit 106 may further have a washing device for washing out the electrolytic solution 128 or the like attached to the base material 32 after the treatment.

The first feed roller 102 is composed of SUS316, SUS316J1, SUS317, or SUS317L, which may be coated with a copper material. The first feed roller 102 may have an electrically discharged surface. The surface roughness Ry of the first feed roller 102 is preferably at least 5 μm and less than 30 μm, more preferably at least 10 μm and less than 25 μm. The surface roughness Ra thereof is preferably 0.5 to 5 μm, more preferably 1 to 2.5 μm. In the present invention, the surface roughnesses Ry and Ra may be measured by SJ-400 manufactured by Mitutoyo Corporation according to JIS B 0601-1994.

The elastic layer 116 of the elastic roller 112 is composed of a conductive rubber having a hardness of 10 to 70 degree and a thickness of about 5 mm. In the present invention, the hardness of the elastic layer 116 may be measured by ASKER C manufactured by Kobunshi Keiki Co., Ltd.

The force for pressing the base material to be plated 32 to the first feed roller 102 can be changed by controlling the engaging position of the adjusting screw 126 attached to the backside of the spring 122 of the elastic roller 112. The pressure in the nip part between the first feed roller 102 and the elastic roller 112 is preferably 0.2 to 0.6 MPa, more preferably 0.3 to 0.5 MPa. In the present invention, the pressure may be measured by a two-sheet-type, extremely-ultralow-pressure Fuji Prescale manufactured by FUJIFILM Corporation The Fuji Prescale contains two films, a coloring agent (microcapsule) is applied to one of the films, and a developer is applied to the other. When the microcapsule of the coloring agent is broken under the pressure in the nip part, the coloring agent is adsorbed to and chemically reacted with the developer to show red color.

The first feed roller 102 is substantially uniformly brought into contact with the base material to be plated 32 by pressing the elastic roller 112 toward the first feed roller 102. When the pressure in the nip part between the first feed roller 102 and the elastic roller 112 is less than 0.2 MPa, the first feed roller 102 is hardly brought into the substantially uniform contact with the base material to be plated 32. On the other hand, when the pressure in the nip part is more than 0.6 MPa, the resistance to the transport of the base material 32 between the first feed roller 102 and the elastic roller 112 is increased, so that it is difficult to stably convey the base material 32.

[Electroless Plating Treatment Section 108]

In the electroless plating treatment section 108, the base material to be plated 32 having the fine-wire metallic silver portion 16 is subjected to an electroless plating treatment, so that conductive fine particles are deposited on the metallic silver portion 16 to form the first plated layer 20.

Figure 6:
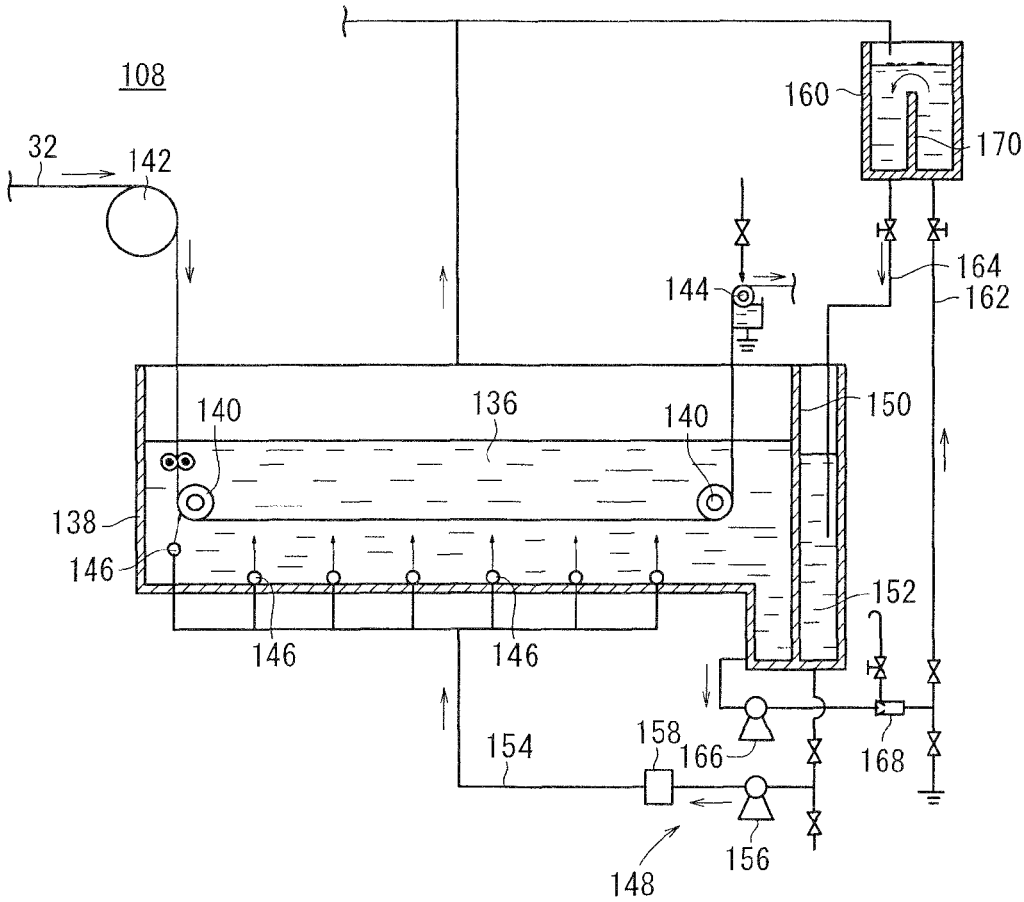
FIG. 6 is a schematic view showing an electroless plating treatment section, preferably used in the apparatus according to the embodiment.

Specifically, as shown in FIG. 6, the electroless plating treatment section 108 has a first plating bath 138 filled with a first plating solution 136, and a plurality of support rollers 140 (two support rollers 140 in this embodiment) disposed in the first plating bath 138. The base material to be plated 32 is horizontally transported in the first plating bath 138. Further, in the electroless plating treatment section 108, a plurality of transport support rollers 142, 144 for supporting and transporting the base material 32 is disposed upstream or downstream of the first plating bath 138.

The base material to be plated 32 is horizontally conveyed between the support rollers 140, 140 in the first plating bath 138, and a plurality of spraying members 146 for spraying a microscopic bubble gas-liquid mixture fluid toward the base material 32 are arranged below the base material 32 along the path thereof. The microscopic bubble gas-liquid mixture fluid (plating solution containing microscopic bubbles) is a mixture fluid of the first plating solution 136 and air, and a gas-liquid mixture supplying device 148 is used to supply the microscopic bubble gas-liquid mixture fluid to the spraying members 146.

The gas-liquid mixture supplying device 148 has a pipe 154 for connecting the bottom of a supply portion 152 and the spraying members 146. The supply portion 152 is divided from the first plating bath 138 by a partition plate 150, and a circulating pump 156 and a filter 158 are disposed on the pipe 154. Further, the gas-liquid mixture supplying device 148 has an air bubble removing bath 160 above the first plating bath 138, and has pipes 162, 164 for connecting the bottom of the first plating bath 138 to the supply portion 152 through the air bubble removing bath 160. A circulating pump 166 and a gas-liquid mixer 168 are disposed on the pipe 162.

The microscopic bubble gas-liquid mixture fluid is introduced through the gas-liquid mixer 168 and the pipe 162 to the air bubble removing bath 160. The pipe 162 is connected to the bottom of the air bubble removing bath 160, and a shuttering board 170 is disposed in the air bubble removing bath 160 below the liquid surface. The pipe 164 is connected to the bottom of the air bubble removing bath 160, opposite to the pipe 162 with respect to the shuttering board 170. The pipe 164 is inserted to the top of the supply portion 152. The microscopic bubble gas-liquid mixture fluid is introduced through the pipe 162 to the bottom of the air bubble removing bath 160, and air bubbles in the fluid float on the liquid surface. Thus, the air bubbles are removed from the microscopic bubble gas-liquid mixture fluid, and then the fluid is moved over the shuttering board 170 to the supply portion 152 through the pipe 164 connected to the bottom of the air bubble removing bath 160.

The microscopic bubble gas-liquid mixture fluid in the supply portion 152 is introduced through the pipe 154 connected to the bottom of the supply portion 152 and the filter 158 to the spraying members 146, and sprayed from the spraying members 146 onto the base material to be plated 32. When the base material 32 is conveyed in the first plating solution 136 in the first plating bath 138, the metallic silver portion 16 of the base material 32 is electroless-plated. Further, by spraying the microscopic bubble-liquid mixture, the first plating solution 136 in the first plating bath 138 can be stirred, mixed, and thereby uniformized.

[Electroplating Treatment Section 110]

Figure 7:
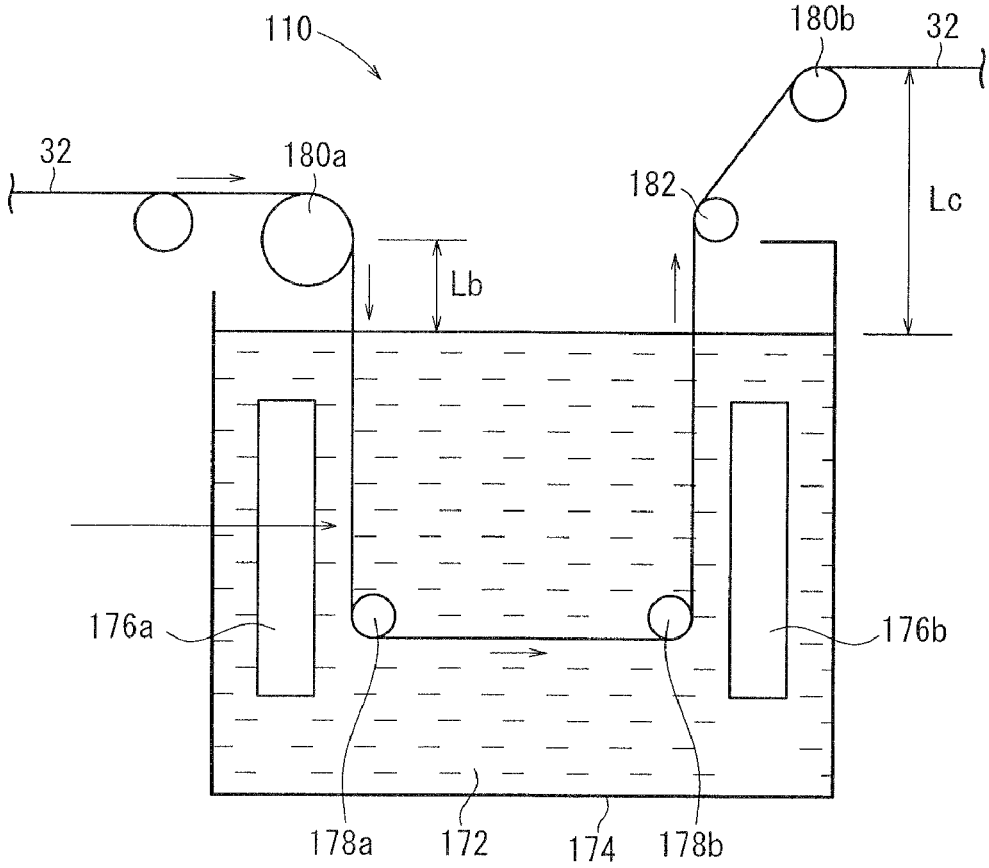
FIG. 7 is a schematic view showing a copper electroplating treatment section, preferably used in the apparatus according to the embodiment.

In the electroplating treatment section 110, as shown in FIG. 7, the long base material 32 (having the first plated layer 20) can be continuously copper-electroplated. Arrows shown in this drawing represent the direction of conveying the base material 32.

The electroplating treatment section 110 has a second plating bath 174, in which a second plating solution 172 is retained. A pair of copper anode plates 176*a* and 176*b* parallel to each other are placed in the second plating bath 174, and a pair of guide rollers 178*a* and 178*b* are rotatably disposed therebetween. The guide rollers 178*a* and 178*b* are parallel to the copper anode plates 176*a* and 176*b*. The guide rollers 178*a* and 178*b* can be moved in the vertical direction, so that the treatment time for plating the base material 32 can be controlled.

A pair of second feed rollers 180*a* and 180*b* (cathode) for introducing the base material 32 into the second plating bath 174 and for applying an electric current to the base material 32 are rotatably disposed above the second plating bath 174. Further, a draining roller 182 is rotatably disposed upstream of the exit-side second feed roller 180*b* above the second plating bath 174 under the exit-side second feed roller 180*b*. A water-washing spray (not shown) for removing the plating solution from the base material 32 is placed between the draining roller 182 and the exit-side second feed roller 180*b*.

The copper anode plates 176*a* and 176*b* are connected to a plus terminal of an electrical source device (not shown) by an electrical wire (not shown), and the second feed rollers 180*a* and 180*b* are connected to a minus terminal of the electrical source device.

The base material 32 is disposed in the electroplating treatment section 110 such that the first plated layer 20 (the mesh surface) faces downward so as to let the silver mesh surface be in contact with the second feed rollers 180*a* and 180*b*.

The second feed rollers 180*a* and 180*b* are obtained by forming a 0.1-mm-thick electroplated copper layer on a mirror-finished stainless steel roller having a diameter of 10 cm and a length of 70 cm, and each of the guide rollers 178*a* and 178*b* and other conveying rollers is a roller having a diameter of 5 cm and a length of 70 cm with no copper plated layers. A sufficient treatment time can be obtained by controlling the positions of the guide rollers 178*a* and 178*b* in the height direction, regardless of the speed of the line.

The distance Lb shown in FIG. 7, between the plating solution surface and the lower end of the contact surface between the entry-side second feed roller 180*a* and the mesh surface of the base material 32, is 10 cm. On the other hand, the distance Lc shown in FIG. 7, between the plating solution surface and the upper end of the contact surface between the exit-side second feed roller 180*b* and the mesh surface of the base material 32, is 20 cm.

[Electroplating Treatment Section 111]

Figure 8:
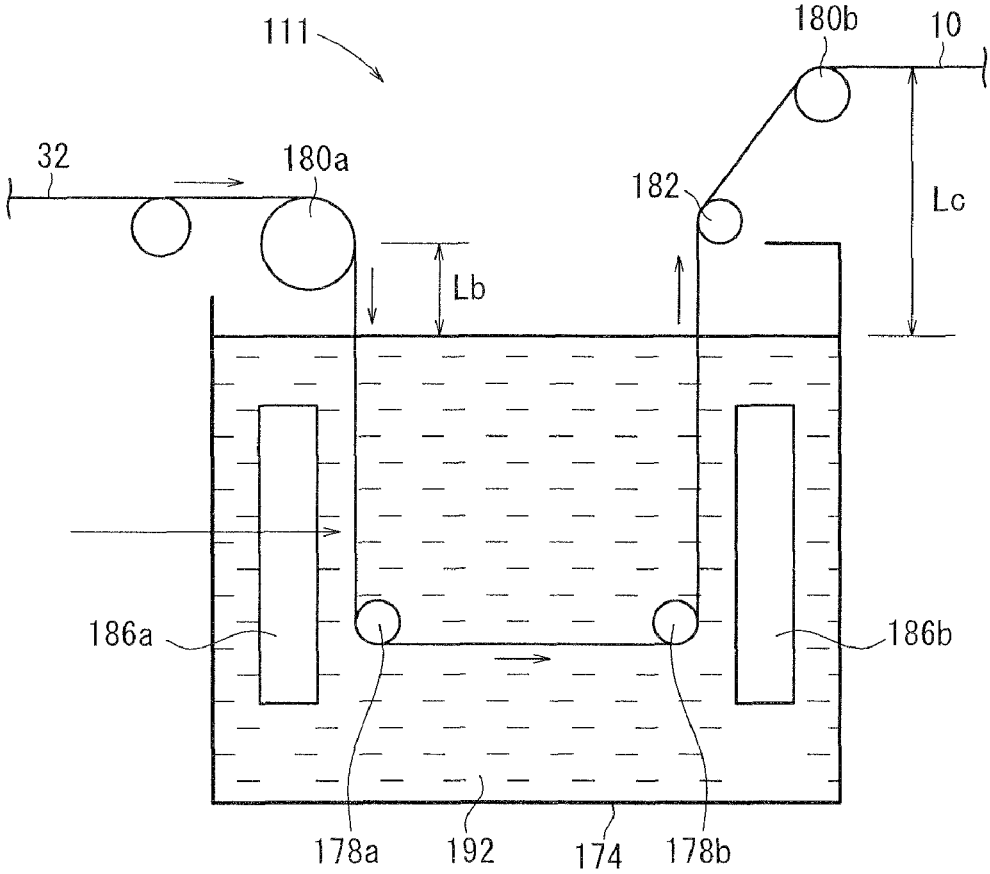
FIG. 8 is a schematic view showing a black electroplating treatment section, preferably used in the apparatus according to the embodiment.

In the electroplating treatment section 111, as shown in FIG. 8, the long base material 32 (having the first plated layer 20 and the second plated layer 22) can be continuously black-electroplated. The basic structure of the electroplating treatment section 111 is equal to that of the electroplating treatment section 110 shown in FIG. 7. In the treatment sections 110 and 111 of FIGS. 7 and 8, the same components are represented by the same numerals, and overlapping explanations therefor are omitted. As shown in FIG. 8, the electroplating treatment section 111 is different from the section 110 in that a third plating solution 192 is contained in the plating bath 174, and a pair of anode plates 186*a* and 186*b* disposed in the plating bath 174 is composed of a metal material suitable for the black plating. For example, in the case of black nickel-zinc electroplating, it is preferred that the anode plates 186*a* and 186*b* are elutable nickel metal plates, and the metal composition ratio of the third plating solution 192 is uniformly controlled by a replenisher.

The base material 32 is copper- and black-electroplated as described above, and then is dried and wound. The conductive material 10 according to this embodiment can be produced in this manner.

As described above, the first plated layer 20, the second plated layer 22, and the third plated layer 23 are formed on the metallic silver portion 16 of the base material 32. The silver content of the metallic silver portion 16 is preferably 50% by mass or more, more preferably 60% by mass or more, based on the total mass of metals in the conductive metal portion.

The metal content of the conductive metal portion, containing the metallic silver portion 16, the first plated layer 20, the second plated layer 22, and the third plated layer 23, is preferably 80% by mass or more, more preferably 90% by mass or more, based on the total mass of the conductive metal portion.

In this embodiment, the base material to be plated 32 has the transparent support and the silver halide emulsion layer 28 formed thereon, and the silver halide emulsion layer 28 is exposed and developed to form the metallic silver portion 16 in a desired shape by using the producing apparatus of the present invention. Since the metallic silver portion 16 is formed by exposing and developing the silver halide emulsion layer 28, the metallic silver portion 16 can have a pattern of remarkably fine wires. The base material 32 having such a metallic silver portion 16 is subjected to the plating treatment, whereby the conductive particles are deposited on the metallic silver portion 16 to form the conductive metal portion. Thus, an electromagnetic-shielding material having the large light transmittable portion 18 and the metal portion with the pattern of remarkably fine wires can be obtained.

<Light-Transmittable, Electromagnetic-Shielding Film>

In the light-transmittable, electromagnetic-shielding film containing the conductive material produced according to the present invention, the thickness of the support is preferably 5 to 200 μm, more preferably 30 to 150 μm. When the thickness is 5 to 200 μm, the film can have a desired visible light transmittance and can be easily handled.

The thickness of the metallic silver portion on the support before the physical development and/or plating treatment can be appropriately selected by controlling the amount of a silver salt-containing layer coating liquid applied to the support. The thickness of the metallic silver portion is preferably 30 μm or less, more preferably 20 μm or less, further preferably 0.01 to 9 μm, most preferably 0.05 to 5 μm. The metallic silver portion preferably has a patterned shape. The metallic silver portion may have a monolayer structure or a multilayer structure containing two or more layers. In a case where the metallic silver portion has a patterned multilayer structure containing two or more layers, the layers may have different wavelength color sensitivities, and different patterns may be formed in the layers by using exposure lights with different wavelengths. A light-transmittable, electromagnetic-shielding film having such a patterned multilayer metallic silver portion can be used as a high-density printed circuit board.

In the case of using the conductive material for an electromagnetic-shielding material for a display, it is preferred that the conductive metal portion has a smaller thickness, since the viewing angle of the display is increased, as the thickness is reduced. Further, in the case of using the conductive material for a conductive wiring material, such a smaller thickness is required for achieving a higher density. In view of these points, the thickness of the conductive metal layer in the conductive metal portion is preferably less than 9 μm, more preferably at least 0.1 μm and less than 5 μm, further preferably at least 0.1 μm and less than 3 μm.

In the present invention, the thickness of the metallic silver portion can be desirably controlled by changing the coating thickness of the silver salt-containing layer, and the thickness of the conductive metal particle layer can be controlled in the physical development and/or the plating treatment, whereby a light-transmittable, electromagnetic-shielding film having a thickness of less than 5 μm, preferably less than 3 μm, can be easily produced.

In conventional photolithography methods, most of metal thin films must be removed and discarded by etching. In contrast, in the present invention, the pattern formed on the support contains only a minimum amount of the conductive metal. Thus, only a minimal amount of the metal is required, so that production costs and metal waste amount can be reduced.

(Adhesion Layer)

When the electromagnetic-shielding film containing the conductive material according to the present invention is incorporated in an optical filter, a liquid crystal display board, a plasma display panel, another image display panel, an imaging semiconductor integrated circuit such as a CCD, or the like, the film may be bonded thereto by an adhesion layer.

It is preferred that the refractive index difference between a transparent substrate such as a plastic film and an adhesive in the adhesion layer is reduced to prevent lowering of the visible light transmittance. Thus, the adhesive preferably has a refractive index of 1.40 to 1.70 to prevent the lowering of the visible light transmittance.

The adhesive is preferably capable of being fluid by applying heat or pressure, and particularly preferably capable of being fluid by heating at 200° C. or lower or by pressing at 1 $kgf/cm^2$ or more. In this case, the electromagnetic-shielding film according to the present invention, which has the adhesion layer and the conductive layer embedded therein, can be bonded to a body of a display, plastic plate, etc. by the fluid adhesion layer. Since the adhesive can be fluid, the electromagnetic-shielding film can be easily bonded to the body by a lamination or pressing method, particularly by a pressing method, even when the body has a curved surface or a complicated shape. From this point, the adhesive preferably has a softening temperature of 200° C. or lower. The electromagnetic-shielding film is generally used at 80° C. or lower, and thus the softening temperature of the adhesion layer is preferably 80° C. or higher and is most preferably 80° C. to 120° C. in view of workability. The softening temperature is a temperature at which the viscosity becomes $10^{12}$ poise or less, and the adhesive becomes generally fluid within about 1 to 10 seconds at the temperature.

Typical examples of such adhesives that can be fluidized by applying heat or pressure include thermoplastic resins. Examples of the thermoplastic resins include natural rubbers (refractive index n=1.52); (di)ene polymers such as polyisoprenes (n=1.521), poly-1,2-butadienes (n=1.50), polyisobutenes (n=1.505 to 1.51), polybutenes (n=1.513), poly-2-heptyl-1,3-butadienes (n=1.50), poly-2-t-butyl-1,3-butadienes (n=1.506), and poly-1,3-butadienes (n=1.515); polyethers such as polyoxyethylenes (n=1.456), polyoxypropylenes (n=1.450), polyvinyl ethyl ethers (n=1.454), polyvinyl hexyl ethers (n=1.459), and polyvinyl butyl ethers (n=1.456); polyesters such as polyvinyl acetates (n=1.467) and polyvinyl propionates (n=1.467); polyurethanes (n=1.5 to 1.6); ethylcelluloses (n=1.479); polyvinyl chlorides (n=1.54 to 1.55); polyacrylonitriles (n=1.52); polymethacrylonitriles (n=1.52); polysulfones (n=1.633); polysulfides (n=1.6); phenoxy resins (n=1.5 to 1.6); and poly(meth)acrylates such as polyethyl acrylates (n=1.469), polybutyl acrylates (n=1.466), poly-2-ethylhexyl acrylates (n=1.463), poly-t-butyl acrylates (n=1.464), poly-3-ethoxypropyl acrylates (n=1.465), polyoxycarbonyltetramethylenes (n=1.465), polymethyl acrylates (n=1.472 to 1.480), polyisopropyl methacrylates (n=1.473), polydodecyl methacrylates (n=1.474), polytetradecyl methacrylates (n=1.475), poly-n-propyl methacrylates (n=1.484), poly-3,3,5-trimethylcyclohexyl methacrylates (n=1.484), polyethyl methacrylates (n=1.485), poly-2-nitro-2-methylpropyl methacrylates (n=1.487), poly-1,1-diethylpropyl methacrylates (n=1.489), and polymethyl methacrylates (n=1.489). Two or more of these acrylic polymers may be copolymerized or blended, when needed.

The copolymer resins of the acrylic resins include epoxy acrylates (n=1.48 to 1.60), urethane acrylates (n=1.5 to 1.6), polyether acrylates (n=1.48 to 1.49), and polyester acrylates (n=1.48 to 1.54). The urethane acrylates, epoxy acrylates, and polyether acrylates are particularly excellent in adhesiveness. The epoxy acrylates include (meth)acrylic acid adducts of 1,6-hexanediol diglycidyl ether, neopentyl glycol diglycidyl ether, allylalcohol diglycidyl ether, resorcinol diglycidyl ether, diglycidyl adipate, diglycidyl phthalate, polyethylene glycol diglycidyl ether, trimethylolpropane triglycidyl ether, glycerin triglycidyl ether, pentaerythritol tetraglycidyl ether, sorbitol tetraglycidyl ether, etc. Polymers having a hydroxyl group in the molecule, such as the epoxy acryaltes, are effective for improving the adhesion property. Two or more of these copolymer resins may be used in combination if necessary. The softening temperature of the adhesive polymer is preferably 200° C. or lower, more preferably 150° C. or lower, in view of handling. The light-transmittable, electromagnetic-shielding film is generally used at 80° C. or lower, and the softening temperature of the adhesion layer is most preferably 80° C. to 120° C. in view of workability. The weight-average molecular weight of the polymer is preferably 500 or more. In the present invention, the weight-average molecular weight is obtained by using a calibration curve of a polystyrene standard in a gel permeation chromatography. When the molecular weight is less than 500, the adhesive composition is poor in cohesive force, and thus the adhesiveness may be deteriorated. In the present invention, the adhesive may contain an additive such as a diluent, a plasticizer, an antioxidant, a filler, a coloring agent, an ultraviolet absorber, or a tackifier, if necessary. The adhesion layer preferably has a thickness of 10 to 80 μm, and particularly preferably has a thickness of 20 to 50 μm larger than that of the conductive layer.

In a case where the conductive material is stacked on a transparent plastic substrate with the adhesion layer disposed in-between, the refractive index difference between an adhesive coating the geometric shape pattern and the adhesion layer is 0.14 or less. When the refractive index difference between the transparent plastic substrate and the adhesive, or between the adhesive and the adhesion layer is large, the visible light transmittance is reduced. When the refractive index difference is 0.14 or less, the reduction in the visible light transmittance is small. In the case of using a polyethylene terephthalate (refractive index n=1.575) for the transparent plastic substrate, examples of satisfactory materials for the adhesive include epoxy resins having a refractive index of 1.55 to 1.60, such as bisphenol A epoxy resins, bisphenol F epoxy resins, tetrahydroxyphenylmethane epoxy resins, novolac epoxy resins, resorcin epoxy resins, polyalcohol or polyglycol epoxy resins, polyolefin epoxy resins, alicyclic epoxy resins, and halogenated bisphenol resins. Examples of the materials, other than the epoxy resins, include natural rubbers (n=1.52); (di)ene polymers such as polyisoprenes (n=1.521), poly-1,2-butadienes (n=1.50), polyisobutenes (n=1.505 to 1.51), polybutenes (n=1.5125), poly-2-heptyl-1,3-butadienes (n=1.50), poly-2-t-butyl-1,3-butadienes (n=1.506), and poly-1,3-butadienes (n=1.515); polyethers such as polyoxyethylenes (n=1.4563), polyoxypropylenes (n=1.4495), polyvinyl ethyl ethers (n=1.454), polyvinyl hexyl ethers (n=1.4591), and polyvinyl butyl ethers (n=1.4563); polyesters such as polyvinyl acetates (n=1.4665) and polyvinyl propionates (n=1.4665); polyurethanes (n=1.5 to 1.6); ethylcelluloses (n=1.479); polyvinyl chlorides (n=1.54 to 1.55); polyacrylonitriles (n=1.52); polymethacrylonitriles (n=1.52); polysulfones (n=1.633); polysulfides (n=1.6); and phenoxy resins (n=1.5 to 1.6). These materials show a preferred visible light transmittance.

In the case of using an acrylic resin for the transparent plastic substrate, examples of the materials for the adhesive other than the above resins include poly(meth)acrylates such as polyethyl acrylates (n=1.4685), polybutyl acrylates (n=1.466), poly-2-ethylhexyl acrylates (n=1.463), poly-t-butyl acrylates (n=1.4638), poly-3-ethoxypropyl acrylates (n=1.465), polyoxycarbonyl tetramethacrylates (n=1.465), polymethyl acrylates (n=1.472 to 1.480), polyisopropyl methacrylates (n=1.4728), polydodecyl methacrylates (n=1.474), polytetradecyl methacrylates (n=1.4746), poly-n-propyl methacrylates (n=1.484), poly-3,3,5-trimethylcyclohexyl methacrylates (n=1.484), polyethyl methacrylates (n=1.485), poly-2-nitro-2-methylpropyl methacrylates (n=1.4868), polytetracarbanyl methacrylates (n=1.4889), poly-1,1-diethylpropyl methacrylates (n=1.4889), and polymethyl methacrylates (n=1.4893). Two or more of these acrylic polymers may be copolymerized or blended, if necessary.

The copolymer resins of the acrylic resins include epoxy acrylates, urethane acrylates, polyether acrylates, and polyester acrylates. The epoxy acrylates and polyether acrylates are particularly excellent in adhesiveness. The epoxy acrylates include (meth)acrylic acid adducts of 1,6-hexanediol diglycidyl ether, neopentyl glycol diglycidyl ether, allylalcohol diglycidyl ether, resorcinol diglycidyl ether, diglycidyl adipate, diglycidyl phthalate, polyethylene glycol diglycidyl ether, trimethyloipropane triglycidyl ether, glycerin triglycidyl ether, pentaerythritol tetraglycidyl ether, sorbitol tetraglycidyl ether, etc. The epoxy acrylate has a hydroxyl group in the molecule, and thereby is effective for improving the adhesion property. These copolymer resins may be used in combination of two or more if necessary. The weight-average molecular weight of a polymer used as a main component of the adhesive is 1,000 or more. When the molecular weight is less than 1,000, the adhesive composition is poor in cohesive force, and thus shows a deteriorated adhesiveness.

Examples of hardening agents used for the adhesive in the present invention include amines such as triethylenetetramine, xylenediamine, and diaminodiphenylmethane; acid anhydrides such as phthalic anhydride, maleic anhydride, dodecylsuccinic anhydride, pyromellitic anhydride, and benzophenonetetracarboxylic anhydride; diaminodiphenylsulfone; tris(dimethylaminomethyl)phenol; polyamide resins; dicyandiamide; and ethylmethylimidazole. These hardening agents may be used singly or in combination of two or more. The amount of the cross-linking agent added is preferably 0.1 to 50 parts by weight, more preferably 1 to 30 parts by weight, per 100 parts by weight of the polymer. When the amount is less than 0.1 part by weight, the hardening of the adhesive is insufficient. When the amount is more than 50 parts by weight, the adhesive is excessively cross-linked, deteriorating the adhesiveness. An additive such as a diluent, a plasticizer, an antioxidant, a filler, or a tackifier may be added to a resin composition used as the adhesive in the present invention, if necessary. The transparent plastic substrate having the conductive geometric pattern is partly or entirely coated with the adhesive resin composition, and the applied composition is dried and thermally hardened to prepare an adhesion film according to the present invention. The adhesion film having the electromagnetic-shielding property and transparency may be directly bonded to a display of CRT, PDP, liquid crystal, EL, etc., and may be bonded to a plate or sheet such as an acrylic plate or a glass plate and then used in the display, by utilizing the adhesiveness of the adhesion film per se. Further, the adhesion film may be used in a window or casing of a measuring apparatus, a measuring instrument, or a producing apparatus generating an electromagnetic wave, to observe the inside thereof. Furthermore, the adhesion film may be used in a window of an automobile or a building, which may be adversely affected by an electromagnetic wave of a radio tower, a high-tension wire, etc. It is preferred that an earth wire is connected to the geometric pattern drawn by the conductive material.

In the transparent plastic substrate, an area not having the conductive material may have a rough surface for increasing the adhesion property or for transferring the back shape of the conductive material. Though a light may be scattered on the rough surface, resulting in deterioration in the transparency, the scattered reflection on the rough surface can be reduced to the minimum by flatly coating the rough surface with a resin having a refractive index similar to that of the transparent plastic substrate, resulting in exhibition of the transparency. The conductive geometric pattern on the transparent plastic substrate has a remarkably small line width, and thus cannot be visually observed by naked eye. Further, the conductive geometric pattern has a sufficiently large pitch, and is transparent apparently. However, the pitch of the geometric pattern is sufficiently small as compared with the wavelength of the electromagnetic wave to be shielded, and therefore the film can show an excellent shielding property.

In a case where a film of a highly thermal-adhesive resin such as an ethylene-vinyl acetate copolymer resin or an ionomer resin, or a stack of the film and another resin film is used as the transparent substrate, a metal foil can be stacked on the transparent substrate without adhesion layers as described in Japanese Laid-Open Patent Publication No. 2003-188576. In general, the stacking is achieved by a dry lamination method using an adhesion layer, etc. Examples of adhesives for the adhesion layer include acrylic resins, polyester resins, polyurethane resins, polyvinyl alcohol resins, vinyl chloride-vinyl acetate copolymer resins, and ethylene-vinyl acetate copolymer resins, and further include thermosetting resins and ionizing radiation hardening resins such as uitraviolet curing resins and electron beam curing resins.

In general, the surface of a display is composed of a glass plate, and the transparent plastic film is bonded to the glass plate by a tackiness agent. When an air bubble is generated in the adhesion surface or the film is peeled from the glass plate, an image may be undesirably distorted or a displayed color may be disadvantageously different from the desired color. The air bubble generation and the peeling of the film are always caused when the tackiness agent is separated from the plastic film or the glass plate. The adhesive is separated at an adhesion surface with weaker adhesiveness between the adhesive and the plastic film or the glass plate. Thus, the tackiness agent needs to have a high adhesiveness to both the plastic film and the glass plate at high temperature. Specifically, the adhesion forces between the tackiness agent layer and the transparent plastic film and between the adhesive layer and the glass plate are preferably 10 g/cm or more, more preferably 30 g/cm or more, at 80° C. Though the adhesion force may be more than 2000 g/cm, the tackiness agent showing such a force is disadvantageous in the bonding procedure in some cases. The tackiness agent layer may have an area not facing the transparent plastic film, and an interleaf (separator) may be formed on the area to prevent the area from unnecessarily bonding to another component.

The tackiness agent is preferably transparent. Specifically, the total light transmittance of the adhesive is preferably 70% or more, more preferably 80% or more, most preferably 85% to 92%. Further, the adhesive is preferably thin in haze. Specifically, the haze of the adhesive is preferably 0% to 3%, more preferably 0% to 1.5%. It is preferred that the tackiness agent used in the present invention is colorless from the viewpoint of not changing the displayed original color. Even when the resin for the tackiness agent is colored, a thinner tackiness agent layer can be substantially colorless. Further, the tackiness agent may be purposefully colored as described hereinafter.

Examples of the tackiness agents having the above property include acrylic resins, α-olefin resins, vinyl acetate resins, acrylic copolymer resins, urethane resins, epoxy resins, vinylidene chloride resins, vinyl chloride resins, ethylene-vinyl acetate resins, polyamide resins, and polyester resins. Among them, the acrylic resins are preferred. The adhesiveness of the resin can be improved by reducing the amount of a cross-linking agent, by adding a tackifier, by modifying an end group of the molecule, etc. in the polymerization synthesis of the tackiness agent. Further, the adhesion property of the tackiness agent can be improved by modifying the surface of the transparent plastic film or the glass plate that is to be bonded to the tackiness agent, even if the same tackiness agent is used. The surface may be modified by a physical treatment such as a corona discharge treatment or a plasma glow treatment, or by forming an underlayer for improving the adhesion property.

It is preferred that the tackiness agent layer has a thickness of about 5 to 50 μm from the viewpoints of the transparency, colorless property, and handling property. In the case of using an adhesive for the tackiness agent layer, the thickness of the adhesive may be reduced within the above range, specifically may be 1 to 20 μm. The thickness may be increased above the range as long as the layer does not change the original color of the display and has a sufficient transparency.

(Peelable Protective Film)

A peelable protective film may be formed in the electromagnetic-shielding film containing the conductive material according to the present invention.

The protective film is not necessarily disposed on the both surfaces of the electromagnetic-shielding film. The protective film may be used such that, as shown in FIG. 2(a) of Japanese Laid-Open Patent Publication No. 2003-188576, a protective film (20) is disposed only on a mesh metal foil (11') of a stack (10) and is not disposed on a transparent substrate film (14). Alternatively, the protective film may be used such that, as shown in FIG. 2(b) of the patent publication, a protective film (30) is disposed only on a transparent substrate film (14) of a stack (10) and is not disposed on a metal foil (11'). The numerals in parentheses represent referential signs of the above patent publication in this paragraph and the following several paragraphs.

The layer structure and the production of a stack in the electromagnetic-shielding film will be described below with reference to FIGS. 3(a) to 3(f) of the above patent publication. The stack contains at least the transparent support 12 and a transparent electromagnetic-shielding layer having a mesh pattern with densely arranged opening portions. The process of stacking the protective film (the protective film (20) and/or the protective film (30)) will be described after the production of the stack is described.

First, as shown in FIG. 3(a) of the above patent publication, a transparent substrate film (14) (the transparent support 12) and a metal foil (11) are stacked with an adhesion layer (13) disposed therebetween to prepare a stack. The transparent substrate film (14) may be composed of an acrylic resin, a polycarbonate resin, a polypropylene resin, a polyethylene resin, a polystyrene resin, a polyester resin, a cellulose resin, a polysulfone resin, or a polyvinyl chloride resin. In general, the transparent substrate film (14) is preferably composed of a polyester resin excellent in mechanical strength and light transmittance, such as a polyethylene terephthalate resin. The thickness of the transparent substrate film (14) is preferably about 50 to 200 μm in view of the mechanical strength and curving resistance, though not restrictive. Though the thickness of the transparent substrate film (14) may be above the range, the thickness does not have to be increased in the case of stacking the electromagnetic-shielding sheet (1) (the light-transmittable, electromagnetic-shielding film 10) on another transparent substrate. One or both of the surfaces of the transparent substrate film (14) may be corona discharge-treated or covered with an easy adhesion layer if necessary.

As shown in FIG. 4 of the above patent publication, the electromagnetic-shielding sheet (1) is used such that the above stack is placed on a substrate with an infrared cutting filter layer or the like disposed therebetween, and a sheet for strengthening the outermost surface, improving the antireflection property, or improving the antifouling property is placed on the both surfaces of the resultant stack. The protective film has to be peeled off before the further stacking process, and thus the protective film on the metal foil is preferably peelable.

The peeling resistance of the protective film on the metal foil is preferably 5 mN/25 mm width to 5 N/25 mm width, more preferably 10 to 100 mN/25 mm width. When the peeling resistance is less than the lower limit, the protective film can be peeled off too easily by handling or indeliberate contact. On the other hand, when the peeling resistance is more than the upper limit, a large force is required to peel the protective film. Further, when the protective film is peeled, also the mesh metal foil may be disadvantageously separated from the transparent substrate film (or the adhesion layer).

In the electromagnetic-shielding film according to the present invention, the mesh metal foil may be placed on the transparent support 12 with the adhesion layer therebetween to form the stack, and the stack may further contain a black layer. The protective film may be disposed on the lower surface (i.e., the side facing the transparent support 12) of the stack, to prevent the lower surface of the transparent support 12 from being scratched or damaged by handling or indeliberate contact or to prevent the outer surface of the transparent support 12 from being contaminated or degraded in the steps of forming and etching a resist layer on the metal foil, particularly in the etching step.

The protective film has to be peeled off before the further stacking process, and thus also the protective film on the transparent support 12 is preferably peelable. The peeling resistance of the protective film on the transparent support 12 is preferably 5 mN/25 mm width to 5 N/25 mm width, more preferably 10 to 100 mN/25 mm width. When the peeling resistance is less than the lower limit, the protective film can be peeled off too easily by handling or indeliberate contact. On the other hand, when the peeling resistance is more than the upper limit, a large force is required to peel the protective film.

It is preferred that the protective film on the transparent support 12 is stable under etching conditions, for example in an etching liquid at 50° C. It is particularly preferred that the protective film is not degraded by an alkali component in the etching liquid when immersed therein for several minutes. It is also preferred that the protective film is stable under dry etching conditions at about 100° C. In a case where the stack is dip-coated (immersion-coated) with a photosensitive resin layer thereon, since the coating liquid is attached to the opposite surface of the stack, it is preferred that the protective film is sufficiently bonded to the photosensitive resin to prevent the photosensitive resin from being peeled off and suspended in an etching liquid. Further, it is also preferred that the protective film has resistance against contamination by an etching liquid containing iron chloride, copper chloride, etc., or against degradation or contamination by a resist remover such as an alkali liquid.

Examples of materials for the preferred protective film include polyolefin resins such as polyethylene resins and polypropylene resins; polyester resins such as polyethylene terephthalate resins; polycarbonate resins; and acrylic resins. From the above described viewpoints, at least a surface of the protective film, which is used as the outermost surface of the stack, is preferably corona discharge-treated or coated with an easy adhesion layer.

Examples of tackiness agents for the protective film include acrylate ester agents, rubber agents, and silicone agents.

The materials and tackiness agents for the protective film on the transparent support can be used for the protective film on the metal foil. Thus, the protective films may be the same or different.

[Optical Filter]

An optical filter according to the present invention may have a functional film containing a functional layer, in addition to the light-transmittable, electromagnetic-shielding film.

(Functional Layer)

In general, viewability of a display screen is reduced due to reflection of lamps, etc. Thus, the functional film has an antireflection (AR) function to prevent the reflection of an external light, an antiglare (AG) function to prevent the reflection of a mirror image, or an antireflection antiglare (ARAG) function containing both the properties. When the surface of the optical filter has a low visible light reflectance, the contrast or the like can be improved while preventing the undesired reflection.

The functional film with the antireflection function has an antireflection layer. Specifically, the antireflection layer may comprise a thin single layer having a ¼ wavelength optical thickness and a low refractive index of 1.5 or less, preferably 1.4 or less in the visible region, composed of a transparent fluorine-containing polymer resin, magnesium fluoride, a silicone resin, silicon oxide, or the like. Further, the antireflection layer may comprise a stack of two or more thin layers having different refractive indices, and each thin layer may contain an inorganic compound such as an oxide, fluoride, silicide, nitride, or sulfide of a metal, or an organic compound such as a silicone resin, an acrylic resin, or a fluorine resin. The antireflection layer is not limited to the examples. In the functional film with the antireflection function, the visible light reflectance of the surface is 2% or less, preferably 1.3% or less, more preferably 0.8% or less.

The functional film with the antiglare function has an antiglare layer transparent to visible light, and the antiglare layer has a surface roughness of about 0.1 to 10 μm. Specifically, the antiglare layer may be prepared by the steps of dispersing particles of an inorganic or organic compound (such as a silica, an organic silicon compound, a melamine compound, or an acrylic compound) in a heat- or light-hardening resin (such as an acrylic resin, a silicone resin, a melamine resin, a urethane resin, an alkyd resin, or a fluorine resin) to obtain an ink, applying the ink to a base, and hardening the applied ink. The particles have an average particle diameter of 1 to 40 μm. Alternatively, the antiglare layer may be prepared by the steps of applying the heat- or light-hardening resin to the base, and hardening the resin while pressing a mold having a desired glossiness or surface roughness. The preparation of the antiglare layer is not limited to these methods. The haze of the functional film with the antiglare function is 0.5% to 20%, preferably 1% to 10%. A too small haze results in an insufficient antiglare function, and a too large haze tends to result in a low sharpness of an image transmitted therethrough.

A hard coating layer is preferably contained in the functional film to improve the abrasion resistance of the optical filter. The material and formation method of the hard coating layer are not particularly limited, and examples of the materials include heat- or light-hardening resins such as acrylic resins, silicone resins, melamine resins, urethane resins, alkyd resins, and fluorine resins. The hard coating layer has a thickness of about 1 to 50 μm. The surface hardness of the functional hard coating layer is H or more, preferably 2H or more, more preferably 3H or more, by the pencil hardness according to JIS K-5400. It is preferred that the antireflection layer and/or the antiglare layer are formed on the hard coating layer to obtain a functional film having the antireflection function and/or the antiglare function in addition to the abrasion resistance.

Due to static charge in the optical filter, dust is easily attached to the optical filter, and a person is often electrically shocked when touches the optical filter. Therefore, an antistatic treatment should be carried out in some cases. Thus, the functional film may be conductive to prevent the static charge. In this case, the conductivity may be a surface resistance of about $10^{11}$ Ω/sq or less. The functional film may be made conductive by a method of adding an antistatic agent to the film, or by a method of forming a conductive layer in the film, etc. Specific examples of the antistatic agents include PELESTAT (trade name, available from Sanyo Chemical Industries, Ltd.) and ELECTROSTRIPPER (trade name, available from Kao Corporation). Examples of the conductive layers include known transparent conductive films composed of ITO, etc., and conductive films composed of a dispersion of conductive ultrafine particles of ITO, tin oxide, etc. It is preferred that the hard coating layer, the antireflection layer, or the antiglare layer contains the conductive film or the conductive fine particles.

It is preferred that the surface of the functional film preferably has an antifouling property, so that attachment of stain such as fingermark can be prevented, or attached stain can be easily removed. Examples of materials having the antifouling property include those non-wettable by water and/or oil, such as fluorine compounds and silicon compounds. Specifically, for example, OPTOOL (trade name, available from Daikin Industries, Ltd.) may be used as the fluorine-based antifouling agent, and TAKATA QUANTUM (trade name, available from NOF Corporation) may be used as the silicon compound. It is preferred that the antireflection layer contains a layer having the antifouling property.

The functional film preferably has an ultraviolet cutting property to prevent deterioration of a dye and a polymer film to be hereinafter described. The functional film having the ultraviolet cutting property may be prepared by a method of adding an ultraviolet absorber in the polymer film, a method of forming an ultraviolet absorbing layer, etc.

In a case where the optical filter is used under a temperature and humidity higher than ordinary temperature and humidity, the dye to be hereinafter described may be deteriorated by water introduced though the film, the water aggregated in the tackiness material or on the adhesion surface may fog the film, and the tackifier in the tackiness material that is phase-separated and deposited by the water may fog the film. Thus, the functional film preferably has a gas barrier property. To prevent the dye deterioration and the fogging, it is important to prevent the impregnation of water into a dye-containing layer and a tackiness material layer. The water vapor permeability of the functional film is preferably 10 g/m$^2$-day or less, more preferably 5 g/m$^2$-day or less.

In this embodiment, the polymer film, the conductive mesh layer, the functional film, and a transparent molding to be hereinafter described are bonded by a visible light transmittable tackiness material or adhesive (first and second light transmittable tackiness layers). Specific examples of the tackiness materials and the adhesives (the first and second light transmittable tackiness layers) include acrylic adhesives, silicone adhesives, urethane adhesives, polyvinyl butyral adhesives (PVB), ethylene-vinyl acetate adhesives (EVA), polyvinyl ethers, saturated amorphous polyesters, and melamine resins. The tackiness material and the adhesive may be in the state of a sheet or a liquid, as long as they have practically sufficient bonding strength. The tackiness material is preferably a sheet of a pressure-sensitive adhesive. After attaching the sheet tackiness material or applying the adhesive, the above components are stacked and bonded. The liquid adhesive may be hardened at room temperature or under heating after the application and bonding. The method for applying the adhesive may be selected from bar coating, reverse coating, gravure coating, die coating, and roll coating methods, etc. depending on the type, viscosity, amount, or the like of the adhesive. The thickness of the layer of the tackiness material or adhesive is not particularly limited, and is generally 0.5 to 50 μm, preferably 1 to 30 μm. It is preferred that a surface, which the tackiness layer is formed on or bonded to, is previously subjected to an easy adhesion treatment such as an easy adhesion coating treatment or a corona discharge treatment to improve the wettability. In the present invention, both the visible light transmittable tackiness material and adhesive are referred to as the light transmittable tackiness material.

In this embodiment, the first light transmittable tackiness layer is used particularly for bonding the functional film to the conductive mesh layer. Above described light transmittable tackiness materials may be used also in the first light transmittable tackiness layer. It is important that the first light transmittable tackiness layer has a thickness such that a depression of the conductive mesh layer can be sufficiently embedded. When the first light transmittable tackiness layer is excessively thin as compared with the conductive mesh layer, the conductive mesh layer is insufficiently embedded, so that a space is formed between the layers. As a result, air bubbles are generated in the depression, and the resultant display filter has turbidity and insufficient light transmittability. On the other hand, when the first light transmittable tackiness layer is excessively thick, the production cost of the tackiness material is increased, and the handling of the material becomes difficult. When the conductive mesh layer has a thickness of d μm, the thickness of the first light transmittable tackiness layer is preferably within a range of (d−2) to (d+30) μm.

The visible light transmittance of the optical filter is preferably 30% to 85%, more preferably 35% to 70%. When the visible light transmittance is less than 30%, the luminance is excessively reduced to deteriorate visibility. On the other hand, when the visible light transmittance is too high, the optical filter cannot act to improve the contrast of a display. It should be noted that, in the present invention, the visible light transmittance is calculated according to JIS R-3106 from wavelength dependence of transmittance in the visible light region.

When the functional film is bonded to the conductive mesh layer using the first light transmittable tackiness layer therebetween, air bubbles are generated in the depression, and the resultant filter has turbidity and insufficient light transmittability, in some cases. In such cases, the gas introduced between the components in the bonding step may be removed or solid-dissolved in the tackiness material by a pressure treatment, etc., so as to remove the fogging and to improve the light transmittability. The pressure treatment may be carried out for the stack of the functional film/the first light transmittable tackiness layer/the conductive mesh layer/the polymer film, or for the display filter according to the embodiment.

The pressure treatment may be carried out using a method of sandwiching and pressing the stack between flat plates, a method of transporting the stack between nip rolls, or a method of introducing the stack in a pressure vessel, though the pressurizing method is not particularly limited. The method of introducing the stack in the pressure vessel to apply pressure to the stack is preferred, because in this method a pressure can be uniformly applied to the entire stack without pressing unevenness, and a plurality of stacks can be treated at the same time. The pressure vessel may be an autoclave.

In the pressure treatment, as the pressure is increased, the generated air bubbles can be reduced and the treatment time can be shortened. In view of the pressure resistance of the stack and a pressurizing apparatus used therein, the pressure is generally about 0.2 to 2 MPa, preferably 0.4 to 1.3 MPa. The pressurizing time depends on various pressurizing conditions and is not particularly limited. As the pressurizing time is increased, the treatment cost is increased. Thus, it is preferred that the treatment is carried out for 6 hours or less under appropriate pressurizing conditions. Particularly in the method using the pressure vessel, the stack is preferably maintained at the predetermined pressure for about 10 minutes to 3 hours.

In some cases, it is preferred that the stack is heated in the pressure treatment. The fluidity of the light transmittable tackiness material can be temporarily increased by heating, whereby the generated air bubbles can be easily removed or solid-dissolved in the tackiness material. The heating is generally carried out at about room temperature to 80° C. in view of heat resistance of each component of the optical filter, though the heating temperature is not particularly limited.

Further, the adhesion force of each component in the optical filter can be preferably improved by the pressure treatment or the pressure/heating treatment.

In the optical filter according to this embodiment, the second light transmittable tackiness layer is formed on a main surface of the polymer film, on which the conductive mesh layer is not formed. Above described light transmittable tackiness materials may be used also in the second light transmittable tackiness layer, and the material of the layer is not particularly limited. The thickness of the second light transmittable tackiness layer is not particularly limited, and is generally 0.5 to 50 μm, preferably 1 to 30 μm. It is preferred that the surface, which the second light transmittable tackiness layer is formed on or bonded to, is previously subjected to an easy adhesion treatment such as an easy adhesion coating treatment or a corona discharge treatment to improve the wettability.

A release film may be formed on the second light transmittable tackiness layer. Thus, the filter may have a structure of the functional film/the first light transmittable tackiness layer/the conductive mesh layer/the polymer film/the second light transmittable tackiness layer/the release film. The release film may be formed by coating the tackiness layer side surface of the polymer film with a silicone, etc. When the optical filter according to this embodiment is bonded to a transparent molding to be hereinafter described or a display (e.g. a front glass of a plasma display panel), the release film is peeled to expose the second light transmittable tackiness layer.

The optical filter according to this embodiment is used mainly for the purpose of shielding electromagnetic wave from various displays, preferably plasma displays.

The plasma display generates a near infrared ray with high intensity. Therefore, the optical filter has to shield not only the electromagnetic wave but also the near infrared ray to the practical level. The transmittance of the optical filter for plasma displays in a wavelength region of 800 to 1000 nm is 25% or less, preferably 15% or less, more preferably 10% or less. Further, the transmitted light color of the optical filter for the plasma display has to be a neutral gray or bluish gray color. This is because, in some cases, it is necessary to maintain or improve the light emission characteristics and contrast of the plasma display, and a white color having color temperature slightly higher than that of a standard white is preferred. Further, it is said that a color plasma display is insufficient in color reproducibility due to unnecessary emission from a fluorescence substance or a discharged gas, and it is preferable to selectively reduce the unnecessary emission. In particular, the red color emission spectrum of the display shows several emission peaks over a wavelength region of about 580 to 700 nm, and the purity of the red color is deteriorated by a relatively strong emission peak at a shorter wavelength, showing an orangish color. The optical property can be controlled by using a dye. Thus, desired optical property can be obtained such that a near infrared absorber is used to cut the near infrared ray, and a dye capable of selectively absorbing the unnecessary emission is used to reduce the emission. Further, also the color tone of the optical filter can be preferably controlled by using a dye capable of absorbing an appropriate visible light.

The dye may be added such that (1) at least one dye is mixed with a transparent resin to form a polymer film or a resin plate, (2) at least one dye is dispersed or dissolved in a high-concentration resin liquid containing an organic solvent and a resin or a resin monomer, and cast into a polymer film or a resin plate, (3) at least one dye is added to a resin binder and an organic solvent to prepare a coating liquid, and applied to a polymer film or a resin plate, or (4) at least one dye is added to a transparent tackiness material. The method of adding the dye is not limited thereto. In this embodiment, the dye may be contained in a substrate, a layer such as a coating, or a tackiness material, and may be present on a surface of the substrate or layer.

The dye is not particularly limited, and may be a near infrared absorber, or a common coloring agent or pigment having a desired absorption wavelength in the visible light region. Examples of the dyes include common commercially available organic dyes such as anthraquinone dyes, phthalocyanine dyes, methine dyes, azomethine dyes, oxazine dyes, immonium dyes, azo dyes, styryl dyes, coumarin dyes, porphyrin dyes, dibenzofuranone dyes, diketopyrrolopyrrole dyes, rhodamine dyes, xanthene dyes, pyrromethene dyes, dithiol dyes, and diiminium dyes. The type and concentration of the dye are not particularly limited, and may be selected depending on the desired absorption wavelength and absorption coefficient of the dye, the desired transmission property and transmittance of the optical filter, a medium in which the dye is dispersed, and the type and thickness of the coating.

The plasma display panel has a high panel surface temperature. Particularly in the case of using the plasma display panel at a high environmental temperature, also the optical filter has a high temperature. Thus, it is preferred that the dye is heat resistant, and is not significantly deteriorated by decomposition or the like at 80° C. Some dyes are insufficient in light resistance in addition to heat resistance. In a case where an ultraviolet or visible ray in a light emitted from the plasma display or an external light causes a deterioration problem, it is important to use an ultraviolet absorber-containing component or an ultraviolet untransmittable component, thereby reducing the deterioration of the dye due to the ultraviolet, or to use a dye that is not significantly deteriorated by the ultraviolet or visible ray. Problems caused by heat, light, humidity, or a combination thereof can be solved in this manner. When the dye is deteriorated, the transmission property of the display filter is changed, whereby the color tone is changed or the near infrared cutting property is reduced. Further, the solubility and dispersion property of the dye in an appropriate solvent are important in view of dispersing the dye in a medium or coating. In the present invention, two or more dyes having different absorption wavelengths may be contained in one medium or coating, and may be contained in two or more media or coatings respectively.

In this embodiment, the above methods (1) to (4) for adding the dye may be used for forming a dye-containing polymer film (A), a dye-containing functional film (C), a dye-containing, light transmittable tackiness material (D1), (D2), or a dye-containing light transmittable tackiness material or adhesive in the optical filter.

Generally the dye is liable to be deteriorated by an ultraviolet ray. The optical filter receives an ultraviolet ray contained in an external light such as a solar light under ordinary use conditions. Thus, it is preferred that at least a dye-containing layer or a layer closer to person, which receives the external light more than the dye-containing layer, has an ultraviolet cutting ability to prevent the deterioration of the dye due to the ultraviolet ray. For example, when the polymer film contains the dye, the dye contained in the polymer film is protected against the ultraviolet in the external light when the first light transmittable tackiness layer and/or the functional film contain an ultraviolet absorber or an ultraviolet cutting functional layer. The ultraviolet cutting ability for protecting the dye is the transmittance of 20% or less, preferably 10% or less, more preferably 5% or less, in the ultraviolet wavelength region of less than 380 nm. The ultraviolet cutting functional layer may be a layer containing an ultraviolet absorber or an inorganic layer capable of reflecting or absorbing the ultraviolet. The ultraviolet absorber may be a known one such as a benzotriazole absorber or a benzophenone absorber. The type and concentration of the ultraviolet absorber are not particularly limited, and may be selected depending on the dispersion property or solubility in the medium, the absorption wavelength, the absorption coefficient, the thickness of the medium, etc. It is preferred that the layer or film having the ultraviolet cutting ability is poor in absorption in the visible region, and thereby does not significantly reduce the visible light transmittance and does not show a color of yellow, etc. In a case where the dye-containing functional film has a dye-containing layer, a functional layer, closer to human than the dye-containing layer, has the ultraviolet cutting ability. In a case where the polymer film contains the dye, a functional layer, closer to human than the film, has the ultraviolet cutting ability.

The dye can be deteriorated when a metal comes into contact therewith. In the case of using such a dye, the dye is preferably positioned such that the contact between the dye and the conductive mesh layer is prevented as much as possible. Specifically, it is preferred that the functional film, the polymer film, or the second light transmittable tackiness layer contains the dye, and it is particularly preferred that the second light transmittable tackiness layer contains the dye.

In the optical filter according to this embodiment, the polymer film, the conductive mesh layer, the functional film, the first light transmittable tackiness layer, and the second light transmittable tackiness layer are disposed in the order of the functional film/the first light transmittable tackiness layer/the conductive mesh layer/the polymer film/the second light transmittable tackiness layer. It is preferred that a conductive mesh film containing the conductive mesh layer and the polymer film is bonded to the functional film by the first light transmittable tackiness layer, and the second light transmittable tackiness layer is formed on a surface of the polymer film, opposite to the surface having the conductive mesh layer.

The optical filter according to this embodiment is attached to a display such that the functional film faces the operator, and the second light transmittable tackiness layer faces the display.

The optical filter according to this embodiment may be used in front of the display such that the optical filter is disposed on a support of a transparent molding to be hereinafter described to form a filter-fronted plate, or the optical filter is bonded to the display by the second light transmittable tackiness layer. In the former method, the optical filter can be relatively easily attached, and the transparent support acts to increase the mechanical strength, so that the former method is suitable for protecting the display. In the latter method, the resultant optical filter is light in weight and thin since the support is not used, and the reflection on the display surface can be preferably prevented.

The transparent molding may be a glass plate or a light transmittable plastic plate. The plastic plate is preferred from the viewpoints of mechanical strength, lightweight, and cracking resistance. The glass plate is hardly deformed by heat, and thus is preferred from the viewpoint of thermal stability. Specifically, the plastic plate may be composed of an acrylic resin such as a polymethyl methacrylate (PMMA), a polycarbonate resin, a transparent ABS resin, etc., and the material of the plastic plate is not limited thereto. Particularly the PMMA has high light transmittability in a wide wavelength region and high mechanical strength, and thereby is preferably used for the plastic plate. The thickness of the plastic plate is not particularly limited as long as it has mechanical strength and rigidity sufficient for maintaining the flatness without deflection. The thickness of the plastic plate is generally about 1 to 10 mm. The glass plate is preferably composed of a semi-tempered or tempered glass, which is chemical-tempering-treated or air-cooling-tempering-treated to improve the mechanical strength. The thickness of the glass plate is preferably about 1 to 4 mm in view of the weight, though not limited thereto. The transparent molding may be subjected to a known pretreatment, if necessary, before bonding the film thereto. A frame having a color such as a black color may be printed on a portion of the transparent molding, corresponding to the periphery of the optical filter.

In the case of using the transparent molding, the optical filter has a structure containing at least the functional film/the first light transmittable tackiness layer/the conductive mesh layer/the polymer film/the second light transmittable tackiness layer/the transparent molding. Another functional film may be bonded by a light transmittable tackiness layer to a main surface of the transparent molding, opposite to the surface to be bonded to the second light transmittable tackiness layer. In this case, the functional film and the another functional film may be different in the function and structure. For example, the another functional film may have an antireflection property to reduce the reflection on the back surface of the optical filter having the transparent support. Further, a functional layer such as an antireflection layer may be formed on the main surface of the transparent molding, opposite to the surface to be bonded to the second light transmittable tackiness layer. In this case, the optical filter may be attached to the display such that the functional layer faces the operator. As described above, it is preferred that the dye-containing layer or the outer layer has the ultraviolet cutting ability.

In general, an electromagnetic wave from a device can be shielded by forming a metal layer in a casing of the device or by using a conductive material in the casing. In the case of a light transmittable device such as a display, a window-shaped electromagnetic-shielding filter having a light transmittable conductive layer, such as the optical filter according to this embodiment, is used. The electromagnetic wave is absorbed to the conductive layer, and then induces a charge. Therefore, unless the charge is escaped by grounding, the optical filter acts as an antenna to oscillate the electromagnetic wave, thereby reducing the electromagnetic-shielding property. Thus, the optical filter has to be electrically connected to a grounding portion of the display, and the first light transmittable tackiness layer and the functional film need to be formed on the conductive mesh layer while remaining a conducting portion that can electrically conduct from the outside. Though the shape of the conducting portion is not particularly limited, it is important not to form a space, from which the electromagnetic wave is leaked, between the optical filter and the display. It is preferred that the conducting portion is continuously formed on the periphery of the conductive mesh layer. Thus, the conducting portion is preferably provided in a frame shape surrounding the displaying portion of the display.

The conducting portion may be a mesh pattern layer or an unpatterned layer of a solid metal foil or the like. In view of improving the electric connection between the optical filter and the grounding portion of the display, the unpatterned layer of a solid metal foil or the like is preferred.

In a case where the conducting portion is the unpatterned layer of a solid metal foil or the like, and/or a case where the conducting portion has a sufficient mechanical strength, the conducting portion per se can be preferably used as an electrode.

In some cases, an electrode is preferably formed in the conducting portion to protect the conducting portion and/or to improve the electric connection between the grounding portion and the conducting portion of a mesh pattern layer. The shape of the electrode is not particularly limited, and it is preferred that the entire conducting portion is covered with the electrode.

The material of the electrode may be selected in view of conductivity, corrosion resistance, adhesion to the transparent conductive layer, etc. from simple substances of silver, copper, nickel, aluminum, chromium, iron, zinc, carbon, etc.; alloys thereof; mixtures of a synthetic resin and the simple substance or the alloy; and mixtures of a borosilicate glass and the simple substance or the alloy. The electrode may be formed by using a paste of the material, and the paste may be printed or applied by a known method. Further, a commercially available conductive tape may be preferably used as the electrode. The both surfaces of the conductive tape have conductivity, and the conductive tape may be a single- or double-faced tape using a carbon-dispersed conductive adhesive. The thickness of the electrode is not particularly limited, and is generally about several μm to several mm.

The optical filter according to this embodiment has excellent optical properties, and thereby can maintain or improve the image quality of the plasma display without significant deterioration of the luminance. Further, the optical filter has excellent electromagnetic-shielding property, and thereby can shield the electromagnetic wave from the plasma display, which is possibly health-damaging. Furthermore, the optical filter can efficiency cut the near infrared ray around 800 to 1000 nm emitted from the plasma display to reduce the adverse effects of the ray on peripheral electronic devices such as remote controllers and optical communication transmission systems, and thus can prevent malfunction of the devices. Furthermore, the optical filter can be produced at low cost with excellent weather resistance.

The conductive material produced by the method or apparatus of the present invention can be used not only for the light-transmittable, electromagnetic-shielding films, but also for radio antennas, fuel cell electrodes, electric bilayer capacitors, biosensor electrodes, and organic transistor electrodes.

The producing method and the producing apparatus of the present invention may be appropriately used in combination with those described in Japanese Laid-Open Patent Publication Nos. 2006-012935, 2006-010795, 2006-228469, 2006-228473, 2006-228478, 2006-228480, 2006-228836, 2006-267627, 2006-269795, 2006-267635, 2006-286410, 2006-283133, 2006-283137, 2004-221564, 2004-221565, 2007-200922, and 2006-352073; International Publication No. 2006/001461; Japanese Laid-Open Patent Publication Nos. 2007-129205, 2007-235115, 2007-207987, 2006-012935, 2006-010795, 2006-228469, 2006-332459, 2007-207987, and 2007-226215; International Publication No. 2006/088059; Japanese Laid-Open Patent Publication Nos. 2006-261315, 2007-072171, 2007-102200, 2006-228473, 2006-269795, 2006-267635, and 2006-267627; International Publication No. 2006/098333; Japanese Laid-Open Patent Publication Nos. 2006-324203, 2006-228478, 2006-228836, and 2006-228480; International Publication Nos. 2006/098336 and 2006/098338; Japanese Laid-Open Patent Publication Nos. 2007-009326, 2006-336057, 2006-339287, 2006-336090, 2006-336099, 2007-039738, 2007-039739, 2007-039740, 2007-002296, 2007-084886, 2007-092146, 2007-162118, 2007-200872, 2007-197809, 2007-270353, 2007-308761, 2006-286410, 2006-283133, 2006-283137, 2006-348351, 2007-270321, and 2007-270322; International Publication No. 2006/098335; Japanese Laid-Open Patent Publication Nos. 2007-088218, 2007-201378, and 2007-335729; International Publication No. 2006/098334; Japanese Laid-Open Patent Publication Nos. 2007-134439, 2007-149760, 2007-208133, 2007-178915, 2007-334325, 2007-310091, 2007-311646, 2007-013130, 2006-339526, 2007-116137, 2007-088219, 2007-207883, 2007-207893, 2007-207910, and 2007-013130; International Publication No. 2007/001008; Japanese Laid-Open Patent Publication Nos. 2005-302508 and 2005-197234; etc.

EXAMPLES

The present invention will be described more specifically below with reference to Examples. Materials, amounts, ratios, treatment contents, treatment procedures, and the like, used in Examples, may be changed without departing from the scope of the present invention. The following embodiments are, therefore, to be considered in all respects as illustrative and not restrictive.

Examples 1 to 12

(Silver Halide Photosensitive Material)

<Preparation of Support>

The surfaces of a biaxially stretched polyethylene terephthalate support having a thickness of 100 μm were each coated with a first undercoat layer and a second undercoat layer having the following compositions.

| <First undercoat layer> | |
|---|---|
| Core-shell-type vinylidene chloride copolymer (1) | 15 g |
| 2,4-Dichloro-6-hydroxy-s-triazine | 0.25 g |
| Fine polystyrene particles (average particle diameter 3 μm) | 0.05 g |
| Colloidal silica (SNOWTEX ZL, particle diameter 70 to 100 μm, available from Nissan Chemical Industries, Ltd.) | 0.12 g |
| Total (containing water) | 100 g |

Further, 10% by mass KOH was added to the above composition to adjust the pH to 6, and the resultant coating liquid was applied to the support such that the dry thickness of the first undercoat layer was 0.9 μm after drying at 180° C. for 2 minutes.

| <Second undercoat layer> | |
|---|---|
| Gelatin | 1 g |
| Methylcellulose | 0.05 g |
| $C_{12}H_{25}O(CH_2CH_2O)_{10}H$ | 0.03 g |
| Proxel | $3.5 \times 10^{-3}$ g |
| Acetic acid | 0.2 g |
| Total (containing water) | 100 g |

The coating liquid having the above composition was applied to the support such that the dry thickness of the second undercoat layer was 0.1 μm after drying at 170° C. for 2 minutes.

<Preparation of Emulsion>

A silver halide emulsion, which contained a water medium, a gelatin, and silver iodobromochloride particles (I content: 0.2 mol %, Br content: 30 mol %, average spherical equivalent diameter: 0.15 μm), was prepared. The amount of the gelatin was 11.1 g per 6.0 g of Ag.

$K_3Rh_2Br_9$ and $K_2IrCl_6$ were added to the emulsion at a concentration of $10^{-7}$ mol/mol silver to dope the silver halide particles with Rh and Ir ions. Further, $Na_2PdCl_4$ was added to the emulsion, and the resultant emulsion was gold-sulfur-sensitized using chlorauric acid and sodium thiosulfate.

<Photosensitive Material>

The obtained silver halide emulsion and a gelatin hardening agent was applied to the polyethylene terephthalate (PET) support such that the amount of the silver applied was 2 g/m$^2$. The PET support had a width of 30 cm, and the emulsion was applied into a width of 28 cm and a length of 100 m.

The both end portions having a width of 1.5 cm were cut off to obtain a roll silver halide photosensitive material S-1 having a width of 27 cm.

(Exposure)

The silver halide photosensitive material was exposed by using a continuous exposure apparatus. In the apparatus, exposure heads using DMDs (a digital mirror devices) described in Japanese Laid-Open Patent Publication No. 2004-1244 were arranged into a width of 55 cm. The exposure heads and exposure stages were arranged on a curved line to focus laser lights onto the photosensitive layer of the photosensitive material. Further, in the apparatus, a feeding mechanism and a winding mechanism for the photosensitive material were disposed, and a buffering bend was formed such that the speed in the exposure part was not affected by change of the exposure surface tension, and feeding and winding speeds. The light for the exposure had a wavelength of 405 nm and a beam shape of 12-μm square, and the output of a laser light source was 100 μJ.

The photosensitive material was exposed in a lattice pattern with a width of 27 cm and a length of 75 cm. In the pattern, 12-μm pixels were tilted at 45 degrees against the longitudinal direction of a roll at a pitch of 300 μm.

(Development)

| Formulation of 1 L of developer | |
|---|---|
| Hydroquinone | 20 g |
| Sodium sulfite | 50 g |
| Potassium carbonate | 40 g |
| Ethylenediaminetetraacetic acid | 2 g |
| Potassium bromide | 3 g |
| Polyethylene glycol 2000 | 1 g |
| Potassium hydroxide | 4 g |
| pH | 10.3 |

| Formulation of 1 L of fixer | |
|---|---|
| Ammonium thiosulfate solution (75%) | 300 ml |
| Ammonium sulfite monohydrate | 25 g |
| 1,3-Diaminopropanetetraacetic acid | 8 g |
| Acetic acid | 5 g |

-continued

| Formulation of 1 L of fixer | |
|---|---|
| Aqueous ammonia (27%) | 1 g |
| pH | 6.2 |

The exposed photosensitive material was treated with the above treatment agents under the following conditions using an automatic processor FG-710PTS manufactured by FUJIFILM Corporation Thus, a development treatment was carried out at 35° C. for 30 seconds, a fixation treatment was carried out at 34° C. for 23 seconds, and a water washing treatment was carried out for 20 seconds at a water flow rate of 5 L/min. As a result, a developed, light transmittable conductive film having a mesh pattern (a conductive metal portion) was obtained.

(Electrification)

The light transmittable conductive film was subjected to an electrification treatment using the following four electrolytic solutions and four electrification methods.

—Activating Treatment A According to the Present Invention—

500 g of sodium sulfate was dissolved in 2 L of a tap water to prepare an activating electrolytic solution. A feed roller having a diameter of 1 cm was placed at a distance of 2 cm from the liquid surface of the electrolytic solution, and the conductive surface of the developed light transmittable conductive film was brought into contact with the feed roller. A carbon electrode was placed as a positive electrode at a distance of 2 cm from the film in the activating solution. Then, an electric current at 0.1 A was applied to the film by the feed roller at the room temperature for 15 seconds to 2 minutes while conveying the film, to activate the film.

The first feed roller was composed of a stainless steel, and had a hydrogen overvoltage of −0.1 V vs. NHE. The mesh pattern (the conductive metal portion) formed by the exposure and development had a hydrogen overvoltage of −0.2 V vs. NHE.

—Activating Treatment B According to the Present Invention—

The light transmittable conductive film was activated in the same manner as the activating treatment A except that 5 g of sodium sulfate was dissolved in 2 L of a tap water to prepare an activating electrolytic solution.

—Activating Treatment C According to the Present Invention—

The light transmittable conductive film was activated in the same manner as the activating treatment A except that 350 g of potassium nitrate was dissolved in 2 L of a tap water to prepare an activating electrolytic solution.

—Comparative Activating Treatment D—

5 g of palladium chloride was dissolved in 2 L of aqueous hydrochloric acid (pH 1.0) to prepare an activating liquid, and the above developed light transmittable conductive film was activated at 40° C. for 15 seconds to 2 minutes by the activating liquid while roller-conveying the film.

(Electroless Plating Treatment)

Electroless plating was carried out using each of the following two electroless plating solutions.

—Electroless Plating Treatment M1—

The film was subjected to a copper electroless plating treatment at 40° C. using an electroless plating solution (a Cu electroless plating solution having a pH of 12.5, containing 0.06 mol/L of copper sulfate, 0.22 mol/L of formalin, 0.07 mol/L of EDTA, 0.1 mol/L of sodium potassium tartrate, 100 ppm of a polyethylene glycol having a molecular weight of 2000, 50 ppm of yellow prussiate of potash, and 20 ppm of α,α'-bipyridine) while roller-conveying the film.

—Electroless Plating Treatment M2—

The film was subjected to a copper electroless plating treatment at 25° C. using an electroless plating solution (a Cu electroless plating solution having a pH of 12.5, containing 0.06 mol/L of copper sulfate, 0.22 mol/L of formalin, 0.3 mol/L of triethanolamine, 200 ppm of a polyethylene glycol having a molecular weight of 1000, and 20 ppm of α,α'-bipyridine) while roller-conveying the film.

(Copper Electroplating Treatment)

The light transmittable conductive film having the mesh pattern formed by the above treatments was subjected to a plating treatment using the electroplating treatment section 110 shown in FIG. 7. The photosensitive material was attached to the electroplating treatment section 110 such that the mesh surface faced downward (the mesh surface was in contact with a pair of the second feed rollers 180*a* and 180*b*).

Each of the second feed rollers 180*a* and 180*b* was obtained by forming a 0.1-mm-thick electroplated copper layer on a stainless steel roller having a rough surface (diameter: 5 cm, length: 70 cm). Each of a pair of the guide rollers 178*a* and 178*b*, and the other conveying rollers was a roller having no plated copper layers (diameter: 5 cm, length: 70 cm). A desired sufficient treatment time was obtained by controlling the positions of the guide rollers 178*a* and 178*b* in the height direction, regardless of the speed of the line.

The distance Lb shown in FIG. 7, between the plating solution surface and the lower end of the contact surface between the entry-side second feed roller 180*a* and the mesh surface of the light transmittable conductive film, was 10 cm. On the other hand, the distance Lc shown in FIG. 7, between the plating solution surface and the upper end of the contact surface between the exit-side second feed roller 180*b* and the mesh surface of the light transmittable conductive film, was 20 cm.

The composition of the plating solution, the immersion treatment time (in-liquid time) in each bath, and the voltage applied to each plating bath in the copper electroplating treatment were as follows. The temperatures of the treatment liquid and washing water were 25° C.

| Composition of copper electroplating solution (replenisher solution had the same composition) | |
|---|---|
| Copper sulfate pentahydrate salt | 75 g |
| Sulfuric acid | 190 g |
| Hydrochloric acid (35%) | 0.06 ml |
| Copper Gleam PCM (available from Rohm and Haas Electric Materials) | 5 ml |
| Total (containing pure water) | 1 L |
| **Treatment time and applied voltage in plating bath** | |
| Water washing | 1 minute |
| Acid washing | 30 seconds |
| Copper electroplating 1 | 30 seconds, 4 V |
| Copper electroplating 2 | 30 seconds, 4 V |
| Copper electroplating 3 | 30 seconds, 3 V |
| Copper electroplating 4 | 30 seconds, 2 V |
| Water washing | 1 minute |

(Black Electroplating Treatment)

The light transmittable conductive film formed by the above treatments was subjected to a plating treatment using the electroplating treatment section 111 shown in FIG. 8. The film was attached to the electroplating treatment section 111 such that the mesh surface faced downward, and the other conditions were set in the same manner as the electroplating treatment section 110.

The composition of the plating solution, the immersion treatment time (in-liquid time) in each bath, and the voltage applied to each plating bath in the black electroplating treatment were as follows. The temperature of the treatment liquid was 35° C., and the temperature of washing water was 25° C.

| Composition of black electroplating solution | |
|---|---|
| Nickel sulfate hexahydrate salt | 98.4 g |
| Zinc sulfate | 22.2 g |
| Ammonium thiocyanate | 17 g |
| Sodium sulfate | 15.7 g |
| Total (containing pure water) | 1 L |
| Treatment time in plating bath | |
| Water washing | 1 minute |
| Acid washing | 30 seconds |
| Black electroplating 1 | 30 seconds |
| Black electroplating 2 | 30 seconds |
| Water washing | 1 minute |
| Rust prevention | 30 seconds |
| Water washing | 1 minute |

A rust prevention solution used in the above treatment had the following formulation.

| Composition of rust prevention solution | |
|---|---|
| Benzotriazole | 2.0 g |
| Methanol | 20 ml |
| Total (containing pure water) | 1 L |

The 75-cm-long film was treated at a line speed of 0.6 m/minute. Thus, light transmittable conductive layer-type, electromagnetic-shielding films of Examples 1 to 12 and Comparative Examples 1 to 5 were produced without surface resistance unevenness respectively. The photosensitive material used, the method of the activating treatment, the electrification time, and the electroless plating time of each example are shown in Table 1.

Each electromagnetic-shielding film was attached to a PDP (plasma display panel) having a pixel pitch of 0.44 mm in the vertical direction, and the moiré degree of each PDP was observed in the front direction and an oblique direction. As a result, moiré was not observed, and it is clear that the above samples can be preferably used as a light transmittable, electromagnetic-shielding film.

[Evaluation]

(Measurement of Surface Resistance)

The surface resistance of each sample was measured by LORESTA GP manufactured by Mitsubishi Chemical Corporation, utilizing a four-probe method.

(Count of Plating Fog)

The plating fog of each sample was obtained as follows.

A 250 times magnification photograph of the mesh of each sample was taken, and point-like plating fogs having a diameter of 1 μm or more in an opening portion were counted. The plating fogs in 20 lattices were counted and averaged.

TABLE 1

| | Activating treatment | Treatment time (second) | Electroless plating solution | Surface resistance (Ω/sq) | Plating fog |
|---|---|---|---|---|---|
| Example 1 | A | 15 | M1 | 0.2 | 0 |
| Example 2 | A | 60 | M1 | 0.1 | 0 |

TABLE 1-continued

| | Activating treatment | Treatment time (second) | Electroless plating solution | Surface resistance (Ω/sq) | Plating fog |
|---|---|---|---|---|---|
| Example 3 | A | 120 | M1 | 0.1 | 1 |
| Example 4 | B | 15 | M1 | 0.2 | 0 |
| Example 5 | B | 60 | M1 | 0.1 | 0 |
| Example 6 | B | 120 | M1 | 0.1 | 0 |
| Example 7 | C | 60 | M1 | 0.2 | 0 |
| Example 8 | A | 15 | M2 | 0.2 | 0 |
| Example 9 | A | 60 | M2 | 0.1 | 0 |
| Example 10 | B | 15 | M2 | 0.1 | 0 |
| Example 11 | B | 60 | M2 | 0.1 | 0 |
| Example 12 | C | 60 | M2 | 0.2 | 0 |
| Comparative Example 1 | D | 0 | M1 | 500 | 1 |
| Comparative Example 2 | D | 15 | M1 | 500 | 1 |
| Comparative Example 3 | D | 60 | M1 | 0.2 | 8 |
| Comparative Example 4 | D | 120 | M1 | 0.1 | 43 |
| Comparative Example 5 | D | 60 | M2 | 0.1 | 17 |

(Evaluation of Result)

The results shown in Table 1 are described in detail below.

In Examples 1 to 3 using the electrification treatment A according to the present invention, the resultant plated films had a low surface resistance and few plating fog. Also in Examples 4 to 7 using the different electrification treatments, the advantageous effects of the present invention could be achieved. Thus, it is clear that the effects of the present invention do not depend on the type and concentration of the electrolytic solution for the electrification treatment.

Also in Examples 8 to 12 using different electroless plating solutions, the advantageous effects of the present invention could be achieved in the same manner as Examples 1 to 7. Thus, it is clear that the effects of the present invention do not depend on the type of the electroless plating solution. The method of the present invention has a wide applicability.

In Comparative Examples 1 to 5 using the comparative activating treatment D, each sample did not have satisfactory resistance value and plating fog property. Thus, it is clear that the electrification treatment D is not suitable for the object of the present invention.

The advantageous effects of the present invention are confirmed by these results.

Example 13

A photosensitive material S-2 was prepared in the same manner as above except that the silver halide emulsion was applied to a PET support such that the amount of applied silver was 7.5 g/m$^2$. The photosensitive material S-2 was subjected to an electrification treatment, an electroless plating treatment M1, a copper electroplating treatment, and a black electroplating treatment in the same manner as Example 2. The resulting conductive sample had a resistance value of 0.1 Ω/Sq and no plating fogs.

Example 14

5 g of silver nitrate and 20 g of trisodium citrate were dissolved in 150 ml of an ion-exchange water, to which slowly added was an aqueous solution prepared by dissolving 5 g of sodium borohydride in 50 ml of an ion-exchange water under stirring. Methanol was then added to the obtained dispersion liquid, so that Ag particles were precipitated. The supernatant liquid was removed, and the Ag particles were washed. The washed particles were dispersed in a mixed solvent of cyclohexanol and 2-ethoxyethanol (50:50 by volume), to obtain an $Ag/Ag_2O$ fine particle mixture dispersion having a concentration of 10% by weight.

Based on an image information input by a computer, the dispersion liquid was printed on a substrate by a piezo-type inkjet printer into a pattern having a pitch of 300 and a wire width of 12 μm. The printed dispersion liquid was dried to prepare a base sample to be plated.

The base sample was subjected to an electrification treatment, an electroless plating treatment M1, a copper electroplating treatment, and a black electroplating treatment in the same manner as in Example 2. The resulting conductive sample had a resistance value of 0.2 Ω/Sq and one plating fog.

Example 15

A 6-μm-thick resin layer composed of a polyurethane resin and fine alumina particles was used as a print anchor layer instead of instead of the second undercoat layer of Example 2. Then, a conductive ink print pattern containing fine silver particles was formed by gravure printing. This sample had the same mesh pattern as Example 2, and was used as a base material to be plated. The sample was subjected to the electrification treatment A according to the present invention, and the electroless plating treatment, the copper electroplating treatment, and the black electroplating treatment in the same manner as in Example 2, to obtain a conductive sample. The resultant transparent conductive sample had a resistance value of 0.2 Ω/Sq and no plating fogs.

The PET surface of the sample produced in Example 2 was bonded to a glass plate having a thickness of 2.5 mm and a size of 950 mm×550 mm, with a transparent acrylic tackiness material disposed therebetween. Before this step, a protective film containing a polyethylene film and an acrylic adhesive layer stacked (SUNITECT Y-26F having the total thickness of 65 μm, available from Sun A. Kaken, Co., Ltd.) was bonded to the conductive mesh by a laminator, to protect the conductive mesh.

Then, an antireflection-functional, near infrared ray-absorbing film having a 100-μm-thick PET film, an antireflection layer, and a near infrared absorber-containing layer CLEARAS AR/NIR (trade name, available from Sumitomo Osaka Cement Co., Ltd.) was bonded to the inside conductive mesh layer other than 20-mm edge portion by disposing a 25-μm-thick acrylic light transmittable tackiness material therebetween. The acrylic light transmittable tackiness layer contained color control dyes for controlling the transmission property of an optical filter (PS-Red-G and PS-Violet-RC available from Mitsui Chemicals, Inc.) Further, an antireflection film REALOOK 8201 (trade name, available from NOF Corporation) was bonded to the opposite main surface of the glass plate by a tackiness material, to produce an optical filter.

Since the optical filter was produced using the electromagnetic-shielding film having the protective film, the numbers of scratches and metal mesh defects of the optical filter were remarkably small. Further, the metal mesh is black-colored, and thus the color of the display image is not affected by the metal color. The optical filter had an electromagnetic-shielding ability and near infrared-cutting ability sufficient for practical use (a transmittance of 15% or less in a region of 300 to 800 nm), and was excellent in visibility due to the both side antireflection layers. Further, the optical filter had a color control function of the dye, and thereby can be used suitably for a plasma display, etc.

The method and apparatus of the present invention for producing a conductive material are not limited to the above embodiments, and various changes and modifications can be made without departing from the scope of the present invention.

What is claimed is:

1. A method for producing a conductive material, comprising the steps of:

exposing and developing a photosensitive film having a support and a silver salt emulsion layer containing a silver salt formed thereon, to form a metallic silver portion;

electrifying said photosensitive film in an electrolytic solution substantially free of plating substances by bringing a metal electrode into contact with said metallic silver portion, the metal electrode having a hydrogen overvoltage higher than a hydrogen overvoltage of the metallic silver portion, said metallic silver portion being used as a cathode; and subjecting said metallic silver portion to a plating treatment to form a conductive layer.

2. The method according to claim 1, wherein said electrolytic solution comprises an electrolyte and a solvent.

3. The method according to claim 2, wherein said electrolyte contains at least one salt selected from the group consisting of alkali metal salts, ammonium salts, perchlorate salts, and borate salts.

4. The method according to claim 2, wherein said solvent contains water and/or a nonaqueous solvent.

5. The method according to claim 4, wherein said nonaqueous solvent contains at least one selected from the group consisting of amides, pyrolidones, nitriles, ketones, and tetrahydrofuran.

6. The method according to claim 1, wherein said plating treatment comprises an electroless plating treatment and/or an electroplating treatment.

7. The method according to claim 6, wherein said electroplating treatment comprises a copper electroplating treatment and/or a black electroplating treatment.

8. The method according to claim 1, wherein in the electrifying step, said metallic sliver portion used as the cathode has a surface resistance of 10 to 10000 Ω/sq.

9. The method according to claim 1, wherein an oxide or a sulfide generated on the conductive metal portion is removed.

10. The method according to claim 1, wherein the electrifying is performed at a current of 0.001 to 10 $A/dm^2$.

* * * * *